US009443481B2

(12) United States Patent
Honda et al.

(10) Patent No.: US 9,443,481 B2
(45) Date of Patent: Sep. 13, 2016

(54) LCD DRIVER IC

(71) Applicant: Synaptics Display Devices GK, Tokyo (JP)

(72) Inventors: Hideaki Honda, Kodaira (JP); Hirofumi Sonoyama, Tokyo (JP); Hiroki Takeuchi, Tokyo (JP)

(73) Assignee: Synaptics Display Devices GK, Tokyo (JP)

( * ) Notice: Subject to any disclaimer, the term of this patent is extended or adjusted under 35 U.S.C. 154(b) by 85 days.

(21) Appl. No.: 14/328,392

(22) Filed: Jul. 10, 2014

(65) Prior Publication Data

US 2015/0015551 A1 Jan. 15, 2015

(30) Foreign Application Priority Data

Jul. 11, 2013 (JP) ..... 2013-145248

(51) Int. Cl.
*G09G 3/36* (2006.01)
*G09G 3/20* (2006.01)

(52) U.S. Cl.
CPC ..... *G09G 3/3611* (2013.01); *G09G 3/2096* (2013.01); *G09G 3/3688* (2013.01); *G09G 2310/0283* (2013.01); *G09G 2350/00* (2013.01); *G09G 2352/00* (2013.01)

(58) Field of Classification Search
None
See application file for complete search history.

(56) References Cited

U.S. PATENT DOCUMENTS 7,248,254 B2 * 7/2007 Kato ..... G09G 3/3688 345/204
2002/0149550 A1 10/2002 Ito et al.
2013/0057763 A1 3/2013 Cha et al.

FOREIGN PATENT DOCUMENTS

JP 2002-311913 A 10/2002
JP 2013-054356 A 3/2013

* cited by examiner

*Primary Examiner* — David D Davis
(74) *Attorney, Agent, or Firm* — Miles & Stockbridge P.C.

(57) ABSTRACT

A liquid crystal display driver IC includes a plurality of communication interface circuits, a plurality of driving circuits which drive a plurality of source lines, and a selector circuit. In order to secure a necessary band-width, a necessary number of circuits, among the plurality of communication interface circuits, is connected in parallel to the communication channels, and an unused circuit is suspended. The selector circuit selectively controls to which one of the plurality of driving circuits each of a plurality of image data outputs respectively received from the connected communication interface circuits is supplied.

20 Claims, 18 Drawing Sheets

Fig.11

| | PIN_2 | |
|---|---|---|
| | 0 | 1 |
| Slot1 | DSI_1 | DSI_2 |
| Slot2 | DSI_2 | DSI_1 |

Fig.12

| PIN_2 | PIN_1 | | | | |
|---|---|---|---|---|---|
| | 0 | | 1 | | |
| | | | | Pixel Data Counter < RGB1201 | |
| | | | | 1 | 0 |
| 0 | F/B=0 | DSI_1→Latch1<br>DSI_2→Latch2 | F/B=0 | DSI_1→Latch1 | DSI_1→Latch2 |
| | F/B=1 | DSI_1→Latch2<br>DSI_2→Latch1 | F/B=1 | DSI_1→Latch2 | DSI_1→Latch1 |
| 1 | F/B=0 | DSI_1→Latch2<br>DSI_2→Latch1 | F/B=0 | DSI_2→Latch1 | DSI_2→Latch2 |
| | F/B=1 | DSI_1→Latch1<br>DSI_2→Latch2 | F/B=1 | DSI_2→Latch2 | DSI_2→Latch1 |

Fig.17

| | PIN_2 | |
|---|---|---|
| | 0 | 1 |
| Slot1 | DSI_1 | DSI_2 |
| Slot2 | DSI_2 | DSI_1 |

Fig.18

| PIN_2 | PIN_1 | | | | |
|---|---|---|---|---|---|
| | 0 | | 1 | | |
| | | | | Pixel Data Counter < RGB1201 | |
| | | | | 1 | 0 |
| 0 | F/B=0 | R_Latch_1→Latch1<br>R_Latch_2→Latch2 | F/B=0 | R_Latch_1→Latch1 | R_Latch_1→Latch2 |
| | F/B=1 | R_Latch_1→Latch2<br>R_Latch_2→Latch1 | F/B=1 | R_Latch_1→Latch2 | R_Latch_1→Latch1 |
| 1 | F/B=0 | R_Latch_1→Latch2<br>R_Latch_2→Latch1 | F/B=0 | R_Latch_2→Latch1 | R_Latch_2→Latch2 |
| | F/B=1 | R_Latch_1→Latch1<br>R_Latch_2→Latch2 | F/B=1 | R_Latch_2→Latch2 | R_Latch_2→Latch1 |

LCD DRIVER IC

CROSS-REFERENCE TO RELATED APPLICATIONS

The Present application claims priority from Japanese application JP 2013-145248 filed on Jul. 11, 2013, the content of which is hereby incorporated by reference into this application.

BACKGROUND

The present invention relates to a liquid crystal display driver integrated circuit (IC), and particularly to a liquid crystal display driver integrated circuit which is connected to a liquid crystal display panel with various resolutions and can be used suitably therefor.

In a liquid crystal display system, a liquid crystal display driver IC receives image data to be displayed from a host processor such as an application processor, and displays an image on the liquid crystal display panel, by controlling gate lines of the liquid crystal display panel and by driving source lines of the liquid crystal display panel. In general, the liquid crystal display driver IC has versatility so as to be suitable for a display panel with various sizes (resolutions), but recently the resolution of the display panel has been increased and it is required to be suitable for a resolution up to 4K×2K, Wide-Quad-XGA (WQXGA: 1600RGB×2560) or the like. Depending upon a tendency of a high resolution of the display panel, an amount of the image data transferred from the host processor is also increased.

For a data transfer from the host processor to the liquid crystal display driver IC, a high speed serial data communication such as a mobile industry processor interface/display serial interface (MIPI/DSI) is used. Here, the MIPI is a communication interface standard for mobile devices which is established by an MIPI alliance formed by a plurality of companies.

In JP-A-2013-054356, a display driver IC which is connected to an application host processor via a communication channel according to the MIPI/DSI is disclosed. The display driver IC, in accordance with a mode switching command, performs switching between a command mode in which image data of a still image is transferred to a display via a frame memory and a video mode in which image data of a moving image is transferred to the display by bypassing the frame memory.

In JP-A-2002-311913, a liquid crystal display device that increases the number of ports of the display data supplied to a liquid crystal display module and a format degree of freedom and that enables test data to be combined, is disclosed. The liquid crystal display device relates to a timing controller circuit which simultaneously operates in parallel by dividing a driver group of the liquid crystal display device into a left half quantity and a right half quantity on a screen. The liquid crystal display device converts the display data of various formats of multiple ports from a display digital data output unit into the display data of the multiple ports divided into the data of the left half quantity and the right half quantity of the screen in a memory, the display data is selectively output by an input selection circuit, and thus it is possible to correspond to various display data.

SUMMARY

The present inventor has reviewed JP-A-2013-054356 and JP-A-2002-311913 and found that there were the following new problems.

First, it was found that, in order to adapt to a resolution improvement of a display panel, there is concern about an insufficient band-width of data transfer of the MIPI/DSI described in, for example, JP-A-2013-054356. WQXGA is a resolution of 1600 RGB×2560 lines, and 4K×2K is configured by approximately 4000 pixels×2000 lines, in most cases, by 4096×2160. When image data with 24 bits of three colors of 8 bit×RGB is assigned to each pixel and the image data of the moving image is transferred by 30 fps (30 frames per second: 30 frame/s), a necessary transfer rate becomes 4096×2160×24×30=5.93 Gbps. The MIPI/DSI includes one clock lane and a maximum of four data lanes, and implements a data transfer amount of 1 Gbps/lane, and accordingly, a band-width of the data transfer performed by one port which is configured by one clock lane and four data lanes, is 4 Gbps. For this reason, one port is insufficient. As a countermeasure against this, it is also possible to take an option to increase a transfer speed per lane, but there is a limit in bandwidth expansion because there are problems in which it is difficult to realize a circuit with good high-frequency characteristics and electromagnetic radiation is deteriorated.

Thus, the present inventor has reviewed a liquid crystal display driver IC in which a plurality of ports are mounted. A technology of making parallel communication channels for expanding the band-width of the data transfer is used routinely for a communication between ICs, but in order to employ the technology in the liquid crystal display device, the following problems to be solved are found in the liquid crystal display driver IC.

Since the host processor or the display panel to be connected is not limited to one type in the liquid crystal display driver IC, it is necessary to have versatility. For example, it is preferable that the size of the display panel to be connected be set so as to be able to be freely selected from various sizes to some degree. In addition, in this case, it is preferable that the band-width required for the data transfer between the liquid crystal display driver IC and the host processor can also be changed. For example, it is preferable that the number of communication channels which perform parallel operation be variably set.

The liquid crystal display driver IC has a function of outputting the input image data to the display panel by left-right reversing, but it is preferable that the same function be implemented even in a case of the parallel communication channels.

In the technology described in JP-A-2002-311913, in order to increase the number of ports of the display data and the format degree of freedom, the data input from the multiple ports of the display data is temporarily stored in the memory, and then is read out to an appropriate output port. It is assumed that the memory is used in this technology, but there is no guarantee that the memory is allowed to be embedded in a general liquid crystal display driver IC in view of a chip cost.

Units used for solving such a problem are described as follows, but other problems and new features will be apparent from the description of the present specification and the accompanying drawings.

The present invention is as follows.

A liquid crystal display driver IC according to the present invention is configured to be able to connect to a host processor and a plurality of communication channels, and is configured to be able to drive a plurality of source lines of a display panel, and drive the source lines of the display panel based on the image data supplied from the host processor via the communication channels. The liquid crystal display drive IC includes a plurality of communication interface circuits, a plurality of driving circuits which drive the plurality of source lines, and a selector circuit. The selector circuit can select to which one of the plurality of driving circuits each of a plurality of image data outputs respectively received from a plurality of communication interface circuits is supplied.

An advantage obtained by the present invention can be simply described as follows.

That is, the liquid crystal display driver IC according to the present invention can have versatility with regard to the number of parallel communication channels which are connected to the host processor and the resolution of a drivable display panel, without damaging a function of left-right reversing the display image. Furthermore, it is possible to configure even a liquid crystal display driver IC without an embedded memory for sorting the display data, and to reduce chip cost.

BRIEF DESCRIPTION OF THE DRAWINGS

FIG. 11 is a truth table for explaining an example of a switching operation of an input side selector performed by a terminal.

FIG. 12 is a truth table for explaining an example of a switching operation of an output side selector performed by a terminal.

FIG. 17 is a truth table for explaining an example of a switching operation of an input side selector performed by a terminal, in the liquid crystal display driver IC with the embedded RAM according to the fourth embodiment.

FIG. 18 is a truth table for explaining an example of a switching operation of an output side selector performed by a terminal, in the liquid crystal display driver IC with the embedded RAM and the mounted pixel data counter according to the fourth embodiment.

DETAILED DESCRIPTION

1. Summary of the Embodiments

Figure 1:
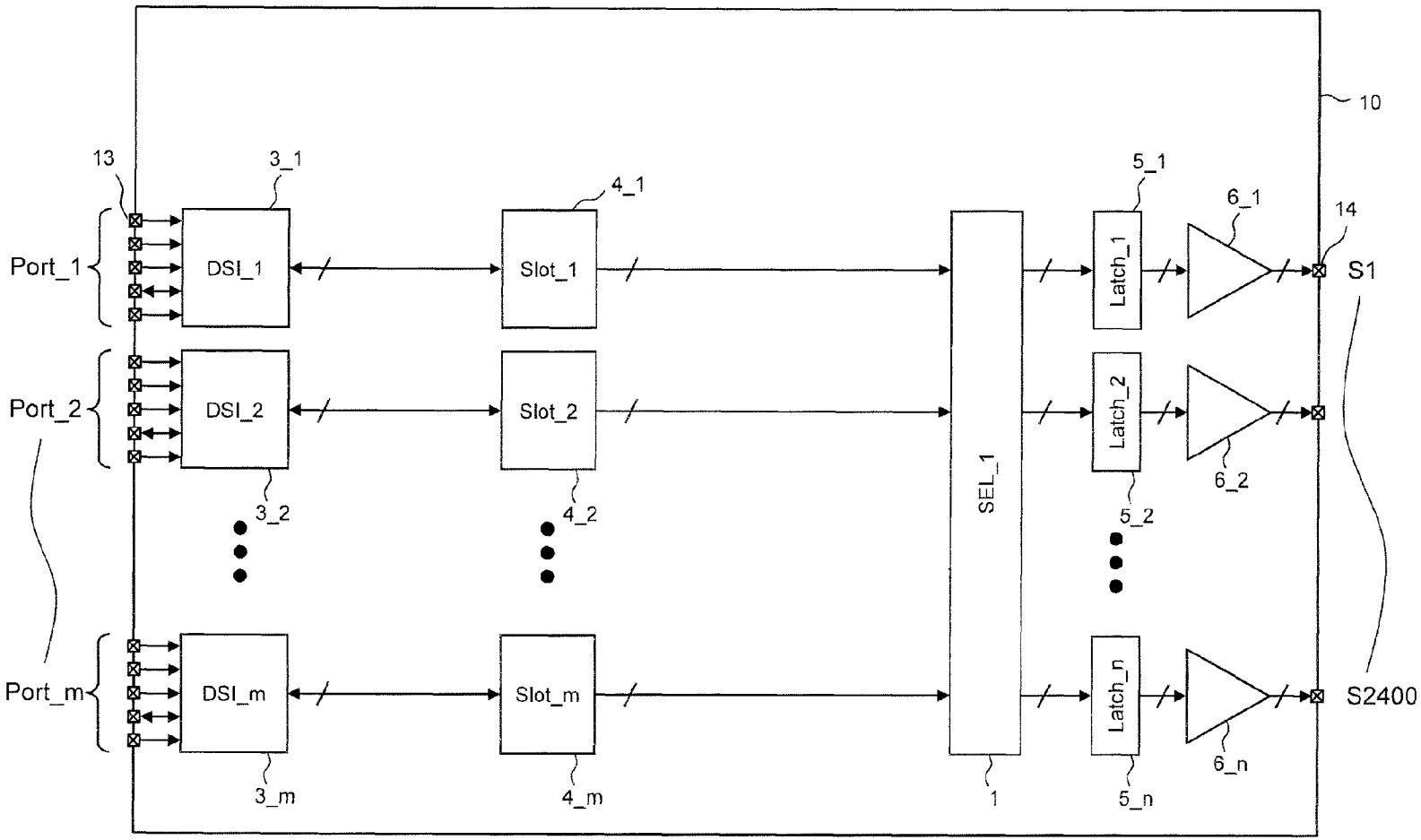
FIG. 1 is a block diagram illustrating a basic configuration of a liquid crystal display driver IC according to the present invention.

First, summary of representative embodiments of the invention disclosed in the application will be described. Reference numerals in drawings in parentheses referred to in description of the summary of the representative embodiments just denote components included in the concept of the components to which the reference numerals are designated.

[1]<Selector Between DSI Port and Source Line Output>

A liquid crystal display driver IC (10) according to the present invention is configured to be able to connect to a host processor (30) and a plurality of communication channels (31), and is configured to be able to drive a plurality of source lines (22, for example S1 to S2400 when a display panel 20 is WQGXA) of the display panel (20). The liquid crystal display driver IC drives the source lines of the display panel based on image data which is supplied from the host processor via the communication channel.

The liquid crystal display driver IC is connected to a plurality of communication interface circuits (3_1 to **3_*m*) which can be connected to the plurality of communication channels, a plurality of driving circuits (6_1 to 6_*n*) which drive each of the plurality of source lines, and each input of the plurality of driving circuits. The liquid crystal display driver IC includes a plurality of latches (5_1 to 5_*n*) that retain the data which is supplied to each driving circuit, and a first selector circuit (1**). The first selector circuit is configured in such a manner that it can be selected to which one of the plurality of latches each of a plurality of image data outputs respectively received from the plurality of communication interface circuits is supplied.

As a result, the liquid crystal display driver IC according to the present invention can have versatility with regard to the number of parallel communication channels which are connected to the host processor and the resolution of a drivable display panel, without damaging a function of left-right reversing a display image. That is, it is possible to freely configure transfer channels of the image data from the required number of communication interface circuits among the plurality of communication interface circuits to the driving circuits for driving source lines at desired positions, and it is possible to freely relate the number of communication interface circuits being used, that is, the number of ports, and the number and position of the source lines being driven.

[2]<Pixel Data Counter>

In section 1, the liquid crystal display driver IC (10) according to one embodiment of the present invention further includes a pixel data counter (7) which counts the number of pieces of pixel data output from at least one communication interface circuit among the plurality of communication interface circuits. The first selector circuit is configured in such a manner that a supply relationship of the image data between the communication interface and the latch can be changed, based on a count value of the pixel data counter.

As a result, even in a case where the number of communication interfaces used for obtaining a required bandwidth is smaller than the number of communication interfaces which are included in the liquid crystal display driver IC, it is possible to select a position which is displayed in accordance with the input sequence, with regard to the image data received from the communication interface circuit connected to the pixel data counter.

For example, there is a case where the resolution of the connected display panel is low. In this case, the number of communication interfaces used for obtaining a required bandwidth is smaller than the number of communication interfaces which are included in the liquid crystal display driver IC. In addition, the number of source lines being driven is smaller than the number of driving circuits which are included in the liquid crystal display driver IC. In this way, in a case where the display panel with a low resolution is connected, it is possible to arbitrarily set the position of the driving circuit which is connected to the source line of the connected display panel.

In addition, for example, since the image data in the communication channel is data-compressed and then transferred, it is the same even in a case where the number of communication interfaces being used is smaller than the number of communication interfaces which are included in the liquid crystal display driver IC. In a case where the display panel with a low resolution is connected, it is possible to arbitrarily set the position of the driving circuit which is connected to the source line of the connected display panel.

[3]<Input Side Selector+Output Side Selector>

In section 1, the liquid crystal display driver IC (10) according to the one embodiment of the present invention further includes a second selector circuit (2), a plurality of video adapters (Slot_1 to Slot_m) (4_1 to **4_*m*), a command adaptor (9), and a control register (8**).

The second selector is configured in such a manner that it can be selected to which video adaptor each of a plurality of image data outputs respectively received from the plurality of communication interface circuits is supplied among the plurality of video adaptors instead of the plurality of latches.

The plurality of video adaptors extracts the image data from the data received from the communication interface, and supplies the extracted image data to the first selector.

The command adaptor is connected to one video adaptor of the plurality of video adaptors, extracts a command from the data received from the communication interface, and sets a value based on the extracted command in the control register.

The first selector is configured to be able to select to which one of the plurality of latches each of the plurality of image data outputs respectively extracted by the plurality of video adaptors is supplied, based on the value set in the control register.

As a result, it is possible to freely switch a relationship between the communication channel through which the host processor transfers the command, and the video adaptor which can extract a command and reflect content thereof to the control register of the liquid crystal display driver IC. Even in a case where a positional relationship between the host processor and embedding of the liquid crystal display driver IC is rotated by 180°, a connection can be made without intersecting the communication channel.

[4]<Input Side Selector+Pixel Data Counter+Output Side Selector>

In section 3, the liquid crystal display driver IC (10) according to the one embodiment of the present invention further includes a pixel data counter (7) which counts the number of pieces of pixel data output from at least one video adaptor of the plurality of video adaptors. The first selector circuit is configured in such a manner that a supply relationship of the image data between the video adaptor and the latch can be changed, based on a count value of the pixel data counter.

As a result, it is possible to provide the liquid crystal display driver IC which obtains all the effects described in sections 2 and 3.

[5]<Designation of Communication Interface Circuit to which Command is Input by a Terminal>

In section 3 or 4, the liquid crystal display driver IC (10) according to the one embodiment of the present invention further includes one or more of a second selector control terminal (PIN_2).

The second selector circuit is configured in such a manner that from which communication interface circuit among the plurality of communication interface circuit the data is received and then supplied to the command adaptor, can be selected, based on the value set in a second selector control terminal.

As a result, it is possible to control the second selector so as to select communication channel through which the data including the command is transferred among the plurality of communication channels connected and to connect to the video adaptor connected to the command adaptor, by a fixed terminal embedded in the display panel, with respect to the liquid crystal display driver IC.

[6]<RAM>

In anyone of sections 1 to 5, the liquid crystal display driver IC (10) according to the one embodiment of the present invention further includes a memory (11) and a memory interface circuit (12). The memory interface circuit is configured in such a manner that it is possible to write the pixel data output from the plurality of communication interface circuits to the memory, to read out the written pixel data from the memory and to supply the read pixel data to the first selector circuit.

As a result, in the same manner as in the liquid crystal display driver IC in which a frame memory is embedded, it is possible to provide the liquid crystal display driver IC which obtains the effects described in sections 1 to 5.

[7]<Designation of the Connected Display Panel Performed by Command>

In any one of sections 1 to 6, the liquid crystal display driver IC (10) according to the one embodiment of the present invention further includes the command adaptor (9) and the control register (8) which includes a first selector control bit (F/B) with one or more bits.

The command adaptor is configured in such a manner that a value set on the basis of the command received from at least one communication interface circuit among the plurality of communication interface circuits can be written to the first selector control bit of the control register.

The first selector circuit selects to which one of the plurality of latches each of the plurality of image data respectively received from the plurality of communication interface circuits is supplied, based on the set value which is stored in the first selector control bit.

As a result, the host processor issues a command with respect to the liquid crystal display driver IC by using at least one of the plurality of communication channels, and thereby it is possible to perform a control suitable for a type such as the size (resolution) of the display panel connected to the liquid crystal display driver IC.

[8]<Designation of the Connected Display Panel Performed by Terminal>

In any one of sections 1 to 6, the liquid crystal display driver IC (10) according to the one embodiment of the present invention further includes one or more of a first selector control terminal (PIN_1).

The first selector circuit is configured to be able to select to which one of the plurality of latches each of the plurality of image data outputs respectively received from the plurality of communication interface circuits is supplied based on the value set in the first selector control terminal.

As a result, it is possible to perform a control suitable for a type such as the size (resolution) of the display panel connected to the liquid crystal display driver IC, by the fixed terminal embedded in the display panel.

[9]<Designation of the Connected Display Panel Performed by Command and Terminal>

In any one of sections 1 to 6, the liquid crystal display driver IC (10) according to the one embodiment of the present invention further includes the command adaptor (9), the control register (8) which includes the first selector control bit of one or more bits, and one or more of the first selector control terminal (PIN_1).

The command adaptor is configured in such a manner that the value set on the basis of the command received from at least one communication interface circuit of the plurality of communication interface circuits is written to the first selector control bit of the control register.

The first selector circuit selects to which one of the plurality of latches each of the plurality of image data outputs respectively received from the plurality of communication interface circuits is supplied, based on the set value which is stored in the first selector control bit and the value set in the first selector control terminal.

As a result, by combining the command issued from the host processor and a state of the first selector control terminal, it is possible to perform a control suitable for a type such as the size (resolution) of the display panel connected to the liquid crystal display driver IC.

[10]<Communication Channel According to MIPI/DSI>

In anyone of sections 1 to 9, the liquid crystal display driver IC (10) according to the one embodiment of the present invention is configured in such a manner that the communication channel includes one clock lane (CLKX_j; j=1 to 4) according to the MIPI/DSI standard and four data lanes (DATAXi_j; i=1 to 4 and j=1 to 4).

As a result, a plurality of ports according to the MIPI/DSI standard is included, and it is possible to provide the liquid crystal display driver IC which can be connected to the host processor.

[11]<Suspending Unused Communication Interface>

In section 1, the liquid crystal display driver IC (10) according to the one embodiment of the present invention can set a communication interface circuit which is not connected to the plurality of communication channels to a low power consumption state among the plurality of communication interface circuits.

As a result, it is possible to suppress unnecessary power consumption due to the unused communication interface circuit.

[12]<Suspending Unused Driving Circuit>

In section 1, the liquid crystal display driver IC (10) according to the one embodiment of the present invention can set a driving circuit which is not connected to the plurality of source lines among the plurality of driving circuits to the low power consumption state.

As a result, it is possible to suppress unnecessary power consumption due to the unused driving circuit.

2. Further Detailed Description of the Embodiments

An embodiment will be described in further detail.

First Embodiment

Basic Configuration (Selector Between DSI Port and Source Line Output)

FIG. 1 is a block diagram illustrating a basic configuration of the liquid crystal display driver IC according to the present invention.

The liquid crystal display driver IC 10 according to the present invention, although not particularly limited, is formed on a single semiconductor substrate of silicon or the like, using a technology of manufacturing, for example, a well-known Complementary Metal-Oxide-Semiconductor (CMOS) field effect transistor semiconductor integrated circuit. The liquid crystal display driver IC 10 can be connected in parallel with the host processor 30 by one or a plurality of communication channels, and based on the image data which is supplied from the host processor 30 via the communication channel, the plurality of source lines which are connected to the display panel 20 can be driven.

Since the liquid crystal display driver IC 10 can be connected in parallel using the plurality of communication channels, the plurality of ports Port_1 to Port_m are included. In each port, the plurality of communication interface circuits (DSI_1 to DSI_m) 3_1 to **3_*m* are provided, and each port is connected to the slots (Slot_1 to Slot_m) 4_1 to 4_*m* in which the data adaptors are embedded. Each signal which configures the ports is connected to the host processor 30 via the pads 13. In order to drive the plurality of source lines (for example S1 to S2400) of the connected display panel, the liquid crystal display driver IC 10 includes driving circuits 6_1 to 6_*n* and latches 5_1 to 5_*n* which retain input data thereof. Outputs of the driving circuits 6_1 to 6_*n* are connected to the display panel 20 via pads 14**.

The liquid crystal display driver IC 10 according to the present invention includes a selector 1 which can control a selection of connection relation of the outputs of the slots (Slot_1 to Slot_m) 4_1 to **4_*m* and the latches 5_1 to 5_*n* which are connected to the driving circuits 6_1 to 6_*n*. The selector 1 performs a control of selecting to which one of the plurality of latches 5_1 to 5_*n* each of the plurality of image data outputs respectively received from the communication interface circuits (DSI_1 to DSI_m) 3_1 to 3_*m* which are provided in the plurality of ports Port_1 to Port_m is supplied. The selector 1 can be configured by, for example, m pieces of 1:n selection circuits (for example, crossbar switches). In addition, the n pieces of latches are divided into several groups, and the selector 1 can be configured to be able to select to which group the slot can supply the image data. According to the former, it is possible to improve a degree of freedom, and according to the latter, it is possible to suppress a circuit size of the selector 1** to a small size.

The number of source lines to be connected and driven is determined by the size or the resolution of the display panel 20 to be connected. Based on this, the driving circuits 6_1 to **6_*n* and the latches 5_1 to 5_*n* to be used are determined. In addition, by the size or the resolution of the display panel 20 to be connected, a band-width required for the data transfer at the time of the supply of the image data from the host processor 30** can be calculated, and thereby it is possible to calculate the number of communication channels to be used in parallel, that is, the number of ports from a data transfer quantity per communication channel of one system.

The communication channel of one system is configured to include one clock lane and four data lanes according to, for example, the MIPI/SDI standard. As a result, it is possible to configure the communication channel in such a manner that the liquid crystal display driver IC 10 can be connected to the host processor including the plurality of ports according to the MIPI/DSI standard.

By setting the unused communication interface circuit 3, the slot 4, the latch 5, and the driving circuit 6 to the low power consumption state, it is possible to decrease the power consumption of the liquid crystal display driver IC 10. The low power consumption state can be realized by a method such as decreasing a bias current which is supplied to the unused circuit, or stopping a power supply to the unused circuit.

The configuration example of the liquid crystal display device 100 which includes the liquid crystal display driver IC 10 according to the present invention will be described.

The liquid crystal display driver IC 10 is an example of a case where m=4 and n=2400 which are illustrated in FIG. 1. That is, the liquid crystal display driver IC 10 includes four communication interface circuits (DSI_1 to DSI_4) 3_1 to 3_4 and four slots (Slot_1 to Slot_4) 4_1 and 4_4 so as to be able to be connected to the communication channels of four ports. Each port is configured to include one clock lane CLKX and four data lanes DATAX0 to DATAX3 according to the MIPI/DSI standard, and includes pads 13_1 to 13_4. In addition, so as to be able to drive the liquid crystal panel 20 with 2400 source lines at a maximum of 1600 RGB, the liquid crystal display driver IC 10 includes 2400 latches 5_1 to 5_2400, the driving circuits 6_1 to 6_2400, and 2400 pads 14. For example, the liquid crystal display driver IC 10 is an example of a case where the display panel 20 is WQGXA.

Figure 2:
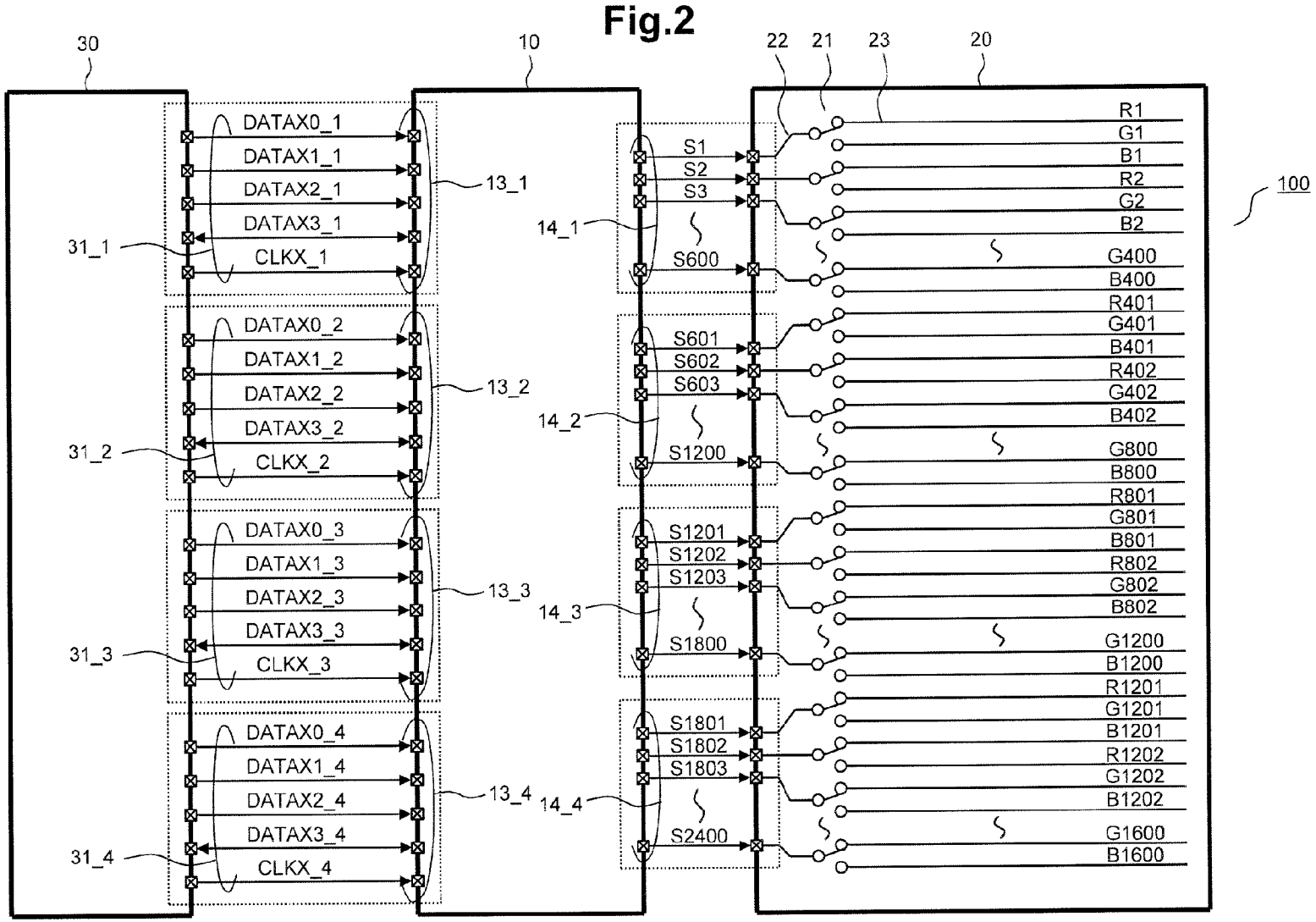
FIG. 2 is a block diagram illustrating a liquid crystal display device 100 in accordance with one connection example (four ports, 1600 RGB) of the liquid crystal display driver IC, a host processor, and a display panel, according to the present invention.

FIG. 2 is a block diagram illustrating the liquid crystal display device 100 which is configured to include the liquid crystal display driver IC 10, the host processor 30 with four communication ports, and the display panel 20 with 1600 RGB. The host processor 30 includes the pads 31_1 to 31_4, and is electrically connected to the pads 13_1 to 13_4 of the corresponding liquid crystal display driver IC 10, and thereby the host processor 30 and the liquid crystal display driver IC 10 are connected in parallel by using the communication channels of four ports according to the MIPI/DSI standard. The display panel 20 is a liquid crystal display panel formed from, for example, a low temperature polysilicon, and is connected to the liquid crystal display driver IC 10 by 2400 pieces of source lines 22 (S1 to S2400), wherein a total of 4800 pieces, which are the product of 1600 pieces and three colors of RGB, of the source lines 23 are multiplexed two by two, and thereby 2400 pieces of the source lines 22 are derived. The output pads of the liquid crystal display driver IC 10 are divided into four groups each having 600 pieces, for the convenience of description, and the groups are termed 14_1 to 14_4. Although not illustrated in FIG. 2, latches 5_1 to 5_600, 5_601 to 5_1200, 5_1201 to 5_1800, and 5_1801 to 5_2400, and driving circuits 6_1 to 6_600, 6_601 to 6_1200, 6_1201 to 6_1800, and 6_1801 to 6_2400 are respectively connected to the pads 14_1, 14_2, 14_3, and 14_4.

An operation of the liquid crystal display device 100 illustrated in FIG. 2 will be described.

The image data displayed by the pixels of a total of 4800 pixels, which are the product of 1600 pieces and three colors of RGB, per line of the display panel 20, is referred to as R1 to R1600, G1 to G1600, and B1 to B1600. The image data of the total of 4800 pieces per line is divided into four groups, for example, ports 1 to 4 and is transferred in parallel. That is, the image data R1 to R400, G1 to G400, and B1 to B400 are transferred via the port Port_1, the image data R401 to R800, G401 to G800, and B401 to B800 are transferred via the port Port_2, the image data R801 to R1200, G801 to G1200, and B801 to B1200 are transferred via the port 3, and the image data R1201 to R1600, G1201 to G1600, and B1201 to B1600 are transferred via the port 4. The image data R1 to R400, G1 to G400, and B1 to B400 which are transferred via the port Port_1 are transferred to the slot 4_1 via the communication interface (DSI_1) 3_1, and are extracted as the image data from a communication packet by the data adaptor of the slot 4_1. The extracted image data R1 to R400, G1 to G400, and B1 to B400 are sequentially written in the latches 5_1 to 5_400 via the selector 1. The image data R1 to R400, G1 to G400, and B1 to B400 written to the latches 5_1 to 5_400 are converted into corresponding voltage levels by the driving circuits 6_1 to 6_400, and the sources lines S1 to S600 are driven by drive signals with the converted voltage levels.

In the example illustrated in FIG. 2, the source lines S1 to S2400 are used by being time-shared. A pair of the latch 5 and the driving circuit 6 also outputs two pieces of image data to one source line during one line period, in the same manner. For example, the image data R1, and G1 are sequentially input in the latch 5_1 during one line period and respectively converted into the corresponding voltage levels, and the source line S1 is driven by the drive signals with the converted voltage levels. The drive signals based on the image data R1 and G1 which are transferred by one piece of source line S1 being time-shared are divided by a demultiplexer 21 of the display panel 20, and drives one source line 23 of corresponding color among the source lines of three colors of RGB for each pixel. By using in parallel the adjacent source line S2, the image data B1 and R2 are transferred during one line period. Hereinafter, in the same manner as described above, the image data G2 and B2 are transferred by using the source line S3, and the image data R3 and G3 are transferred by using the source line S4.

As described above, the selector 1 sequentially transfers the image data extracted from the slot 4_1 to the latches 5_1 to 5_400, and thereby the drive signals based on the image data R1 to R400, G1 to G400, and B1 to B400 which are received via the port Port_1 are output to the source lines S1 to S600. Also in the other ports, in the same manner as above, the selector 1 sequentially transfers the image data extracted from the slot 4_2 to the latches 5_401 to 5_800, and thereby the drive signals based on the image data R401 to R800, G401 to G800, and B401 to B800 which are received via the port Port_2 are output to the source lines S601 to S1200. The selector 1 sequentially transfers the image data extracted from the slot 4_3 to the latches 5_801 to 5_1200, and thereby the drive signals based on the image data R801 to R1200, G801 to G1200, and B801 to B1200 which are received via the port 3 are output to the source lines S1201 to S1800. Furthermore, the selector 1 sequentially transfers the image data extracted from the slot 4_4 to the latches 5_1201 to 5_1600, and thereby the drive signals based on the image data R1201 to R1600, G1201 to R1600, and B1201 to B1600 which are received via the port 4 are output to the source lines S1801 to S2400.

The image data R1 to R1600, G1 to G1600, and B1 to B1600 are image data which are arranged from left to right of one line. In the operation described above, the image data transferred from the host processor 30 are displayed as is without left-right reverse. In contrast, it is possible to display the image data by left-right reversing in the liquid crystal display driver IC 10. In order to left-right reverse, the selector 1 sequentially transfers the image data extracted from the slot 4_1 to the latches 5_1600 to 5_1201, and thereby the drive signals based on the image data R1 to R400, G1 to G400, and B1 to B400 which are received via the port Port_1 are output to the source lines S2400 to S1601. The image data R1, G1, and B1, which are displayed on a left end in a case of the above description in which the left-right reverse are not designated, is displayed on a right end of the display panel 20 when the left-right reverse is designated. The selector 1 sequentially transfers the image data extracted from the slot 4_4 to the latches 5_400 to 5_1, and thereby the drive signals based on the image data R1201 to R1600 G1201 to G1600, and B1201 to B1600 which are received via the port 4 are output to the source lines S400 to S1. The image data R1600, G1600, and B1600, which are displayed on the right end in a case of the above description in which the left-right reverse is not designated, are displayed on the left end of the display panel 20 when the left-right reverse is designated. Also in the two ports of the center portion, in the same manner as above, the selector 1 is controlled in such a manner that the image data is supplied to the latch 5 by being left-right reversed. The selector 1 sequentially transfers the image data extracted from the slot 4_2 to the latches 5_1800 to 5_1201, and thereby the drive signals based on the image data R401 to R800, G401 to G800, and B401 to B800 which are received via the port Port_2 are output to the source lines S1800 to S1201. The selector 1 sequentially transfers the image data extracted from the slot 4_3 to the latches 5_1200 to 5_601, and thereby the drive signals based on the image data R801 to R1200, G801 to G1200, and B801 to B1200 which are received via the port 3 are output to the source lines S600 to S1201.

As a result, by controlling the selector 1, it is possible to display the image data by reversing the left and right of the image, by maintaining as is the output ports or the output sequence of the image data output from the host processor 30.

Figure 3:
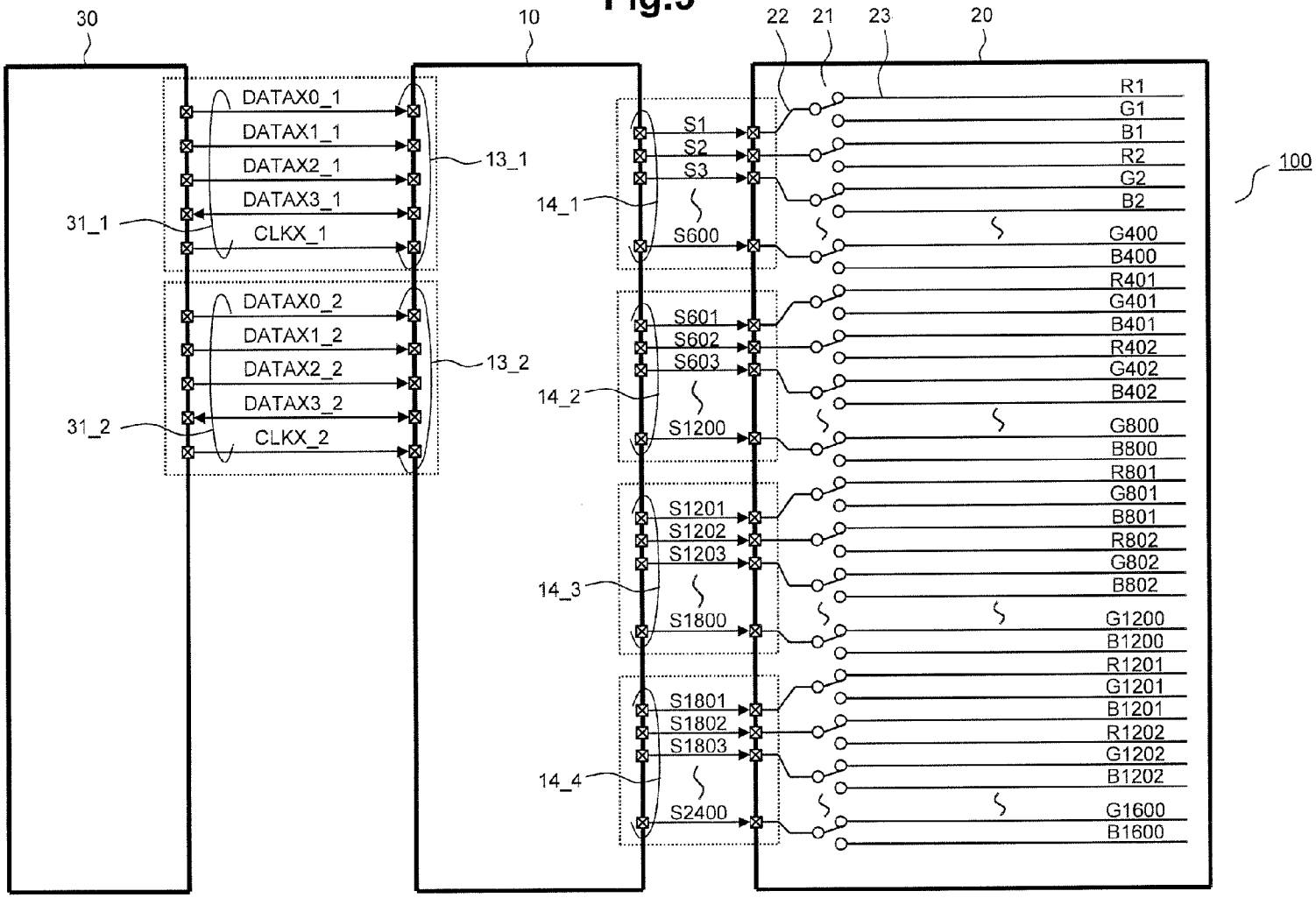
FIG. 3 is a block diagram illustrating the liquid crystal display device 100 in accordance with another connection example (two ports, 1600 RGB) of the liquid crystal display driver IC, the host processor, and the display panel, according to the present invention.

FIG. 3 is a block diagram illustrating the liquid crystal display device 100 which is configured to include the liquid crystal display driver IC 10, the host processor 30 with two communication ports, and the display panel 20 with 1600 RGB. The host processor 30 includes the pads 31_1 to 31_2, and is electrically connected to the pads 13_1 to 13_2 of the corresponding liquid crystal display driver IC 10, and thereby the host processor 30 and the liquid crystal display driver IC 10 are connected in parallel by using the communication channels of two ports according to the MIPI/DSI standard. The pads 13_3 to 13_4 of the liquid crystal display driver IC 10 are not used. Since the display panel 20 and a connection relationship between the display panel 20 and the liquid crystal display driver IC 10 are the same as in FIG. 2, description thereof will not be repeated.

An operation of the liquid crystal display device 100 illustrated in FIG. 3 will be described.

The image data of a total of 4800 pieces per line are transferred by being divided into four groups in the example of FIG. 2, but is transferred in parallel by being divided into two groups, for example, ports 1 to 2, in the example of FIG. 3. That is, the image data R1 to R800, G1 to G800, and B1 to B800 are transferred by using the port Port_1, and the image data R801 to R1600, G801 to G1600, and B801 to B1600 are transferred by using port Port_2. The image data R1 to R800, G1 to G800, and B1 to B800 which are transferred by using the port Port_1 are transferred to the slot 4_1 via the communication interface (DSI_1) 3_1, and are extracted as image data from the communication packet by the data adapter of slot 4_1. The extracted image data R1 to R800, G1 to G800, and B1 to B800 are sequentially written to the latches 5_1 to 5_1200 via the selector 1. The image data R1 to R800, G1 to G800, and B1 to B800 which are written to the latches 5_1 to 5_1200 are converted into the corresponding voltage levels by the driving circuits 6_1 to 6_1200, and the source lines S1 to S1200 are driven by the drive signals with the converted voltage levels.

As described above, the selector 1 sequentially transfers the image data extracted from the slot 4_1 to the latches 5_1 to 5_1200, and thereby the drive signals based on the image data R1 to R800, G1 to G800, and B1 to B800 which are received via the port Port_1 are output to the source lines S1 to S1200. Also in the port Port_2, in the same manner as above, the selector 1 sequentially transfers the image data extracted from the slot 4_2 to the latches 5_1201 to 5_2400, and thereby the drive signals based on the image data R801 to R1600, G801 to G1600, and B801 to B1600 which are received via the port Port_2 are output to the source lines S1201 to S2400.

In contrast, in order to left-right reverse the displayed image, the selector 1 sequentially transfers the image data extracted from the slot 4_1 to the latches 5_2400 to 5_1201, and thereby the drive signals based on the image data R1 to R800, G1 to G800, and B1 to B800 which are received via the port Port_1 are output to the source lines S2400 to S1201. The selector 1 sequentially transfers the image data extracted from the slot 4_2 to the latches 5_1200 to 5_1, and thereby the drive signals based on the image data R801 to R1600, G801 to G1600, and B801 to B1600 which are received via the port Port_2 are output to the source lines S1200 to S1.

As a result, by controlling the selector 1, it is possible to display the image data by reversing the left and right of the image, by maintaining as is the output ports or the output sequence of the image data output from the host processor 30. In addition, the MIPI/DSI includes one clock lane and a maximum of four data lanes, and realizes a data transfer quantity of one Gbps/lane, and thus a band-width of the data transfer performed by one port which is configured by one clock lane and four data lanes is four Gbps. In contrast, when the WQXGA assigns the image data of 24 bits which are the product of eight bits and three colors of RGB for each pixel, in the resolution of 1600 RGB×2560 lines, and the image data of a moving image is transferred by 60 fps (60 frames per second: 60 frame/s), a necessary transfer rate becomes 1600×2560×24×60=5.49 Gbps. In this case, a connection of the host processor 30 with the liquid crystal display driver IC 10 is sufficient by using two ports. In the liquid crystal display driver IC 10 which includes three or more of the communication interfaces (DSI_1 to DSI_4) 3_1 to 3_4 and slots 4_1 to 4_4, in a case where only two ports are used as illustrated in FIG. 3, the unused communication interfaces (DSI_3 to DSI_4) 3_3 to 3_4 and slots 4_3 to 4_4 may be transitioned to a low power consumption state and then stands by. For example, supplying of power may be cut off, or it is possible to perform the transition to the low power consumption state by cutting off or reducing to a minimum a bias current of a receiving circuit of the communication interfaces (DSI_3 to DSI_4) 3_3 to 3_4.

Figure 4:
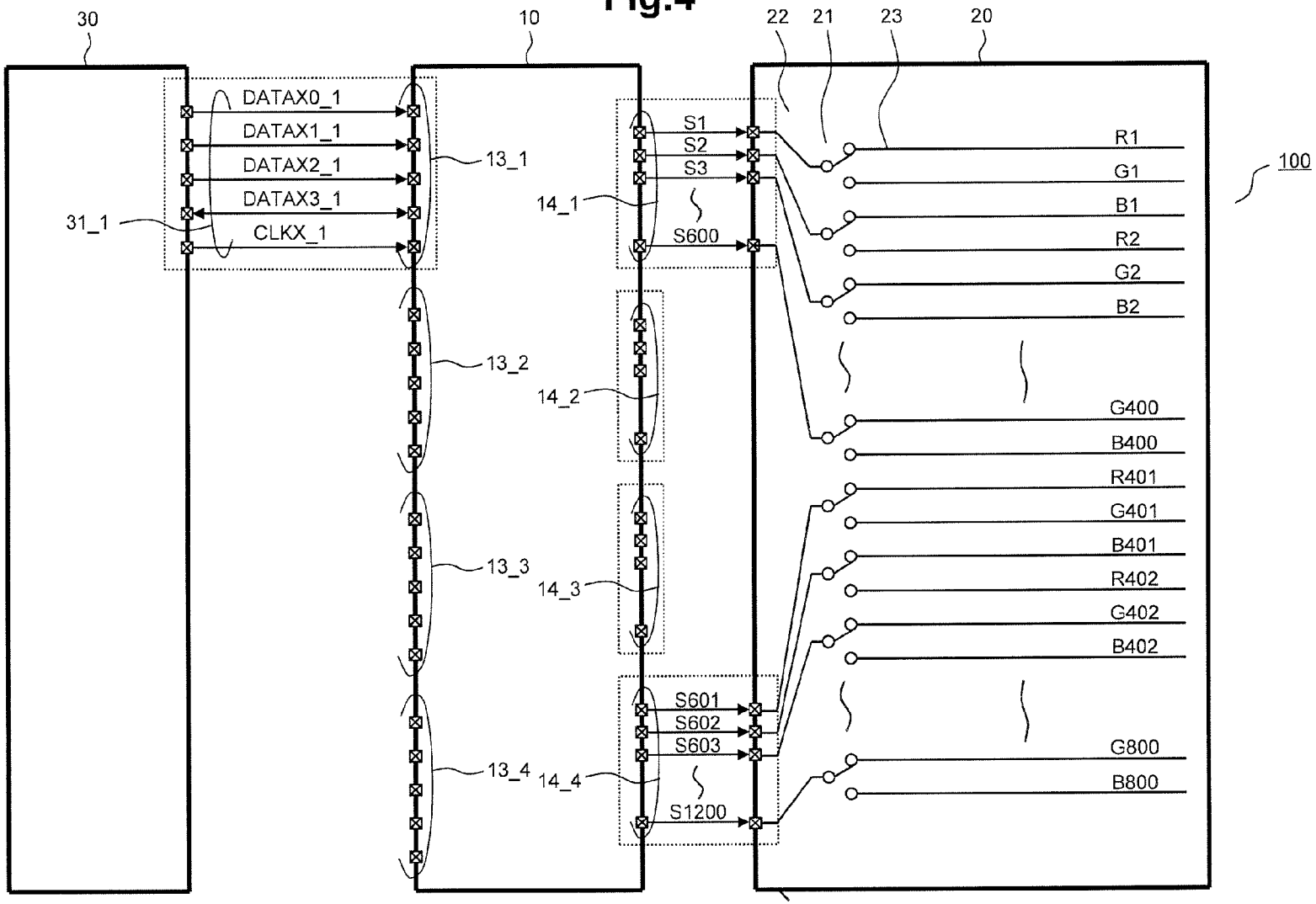
FIG. 4 is a block diagram illustrating the liquid crystal display device 100 in accordance with still another connection example (one port, 800 RGB) of the liquid crystal display driver IC, the host processor, and the display panel, according to the present invention.

FIG. 4 is a block diagram illustrating the liquid crystal display device 100 which is configured to include the liquid crystal display driver IC 10, the host processor 30 with one communication port, and the display panel 20 with 800 RGB. Compared to the examples illustrated in FIGS. 2 and 3, FIG. 4 is an example in which the resolution of a line direction (horizontal direction) of the connected display panel 20 is half, for example, 800 RGB. The resolution may be low, and the band-width of the communication channel may be narrow, and thereby the communication illustrates an example of only one port according to the MIPI/DSI. The host processor 30 includes a pad 31_1, and is electrically connected to the pad 13_1 of the corresponding liquid crystal display driver IC 10. The pads 13_2 to 13_4 of the liquid crystal display driver IC 10 are not used. In the same manner as that illustrated in FIG. 2 and FIG. 3, the display panel 20 is a liquid crystal display panel formed from, for example, a low temperature polysilicon, and the resolution of the horizontal direction is half of that of the display panel 20 illustrated in FIGS. 2 and 3. That is, 2400 source lines 23 formed by RGB, each having 800 pieces, are multiplexed by two pieces, and are connected to the liquid crystal display driver IC 10 by 1200 source lines 22 (S1 to S1200). The output pads of the liquid crystal display driver IC 10, in the same manner as those illustrated in FIGS. 2 and 3, are divided into four groups each having 600 pieces, for the convenience of description, and are referred to as 14_1 to 14_4. Although not illustrated, the pads 14_1, 14_2, 14_3, and 14_4 are connected to the latches 5_1 to 5_600, 5_601 to 5_1200, 5_1201 to 5_1800, and 5_1801 to 5_2400, and the driving circuits 6_1 to 6_600, 6_601 to 6_1200, 6_1201 to 6_1800, and 6_1801 to 6_2400. The source lines 22 of the display panel 20 to be driven are a total of 1200 pieces which are S1 to S1200. 600 pieces of pads contained in a pad group 14_1 are connected to S1 to S600, and 600 pieces of pads contained in a pad group 14_4 are connected to S601 to S1200. 1200 pieces of pads contained in groups 14_2 and 14_3 in a center portion are not connected to source lines. Accordingly, the latches 5_601 to 5_1800 and the driving circuits 6_601 to 6_1800 are not used. The unused latches 5_601 to 5_1800 and the driving circuits 6_601 to 6_1800 may be stand by being transitioned to the low power consumption state. For example, supplying of the clock may be stopped or the supplying of the power may be cut off, or by cutting off or reducing to a minimum the bias current of the output circuit of the driving circuits 6_601 to 6_1800 and/or a boosting circuit, it is possible to perform the transition to the low power consumption state.

In the example illustrated in FIG. 4, among 2400 pieces of pads 14_1, 14_2, 14_3, and 14_4, 1200 pads 14_1 and 14_4 obtained by combining both end pads each having 600 pieces are connected to the display panel 20 to be used, and the pads 14_2 and 14_3 near the center portion are not used, but a use of the pads can be arbitrarily selected. Source line drive pads such as the pads 14_1, 14_2, 14_3, and 14_4 are arranged generally at one side of a long side in the liquid crystal display driver IC. By wiring the source lines 22, which are on the display panel 20, of the liquid crystal display driver IC in such a manner that the pads used in the liquid crystal display driver IC are decentralized as far as possible, it is possible to reduce congestion of the wiring. As illustrated in FIG. 4, the pads 14_1 and 14_4 near both of the ends are connected to the display panel 20 to be used, and the pads 14_2 and 14_3 near the center portion are not used, and thereby, the congestion of the source lines 22, which are on the display panel 20, of the liquid crystal display driver IC, is reduced further than in a case where, for example, the pads 14_1 and 14_2 near one end are used, and the pads 14_3 and 14_4 near the other end are not used.

An operation of the liquid crystal display device 100 illustrated in FIG. 4 will be described.

The image data of a total of 4800 pieces per line are transferred in parallel by being divided into four groups in the example of FIG. 2 and by being divided into two groups in the example of FIG. 3, but the image data of a total of 2400 pieces, which are half the image data of a total of 4800 pieces, per line is transferred by using only one port in the example of FIG. 4. That is, the image data R1 to R800, G1 to G800, and B1 to B800 are all transferred by using the port Port_1, and the other ports 2 to 4 are not used. The communication interfaces (DSI_2 to DSI_4) 3_2 to 3_4 of the unused ports 2 to 4, and slots 4_2 and 4_4 may be stood-by by being transitioned to the low power consumption state. The image data R1 to R800, G1 to G800, and B1 to B800 transferred by using the port Port_1 are transferred from the communication interface (DSI_1) 3_1 to the slot 41, and are extracted as the image data from the communication packets by the data adaptor of the slot 4_1. Among the extracted image data R1 to R800, G1 to G800, and B1 to B800 the image data R1 to R400, G1 to G400, and B1 to B400 respectively are sequentially written to the latches 5_1 to 5_600 via the selector 1, and the image data R401 to R800, G401 to G800, and B401 to B800 are sequentially written to the latches 5_1801 to 5_2400 via the selector 1. The image data R1 to R400, G1 to G400, and B1 to B400 written to the latches 5_1 to 5_600 are converted into the corresponding voltage levels by the driving circuits 6_1 to 6_600, and the source lines S1 to S600 are driven by the drive signals with the voltage levels. The image data R401 to R800, G401 to G800, and B401 to B800 written to the latches 5_1801 to 5_2400 are converted into the corresponding voltage levels by the driving circuits 6_1801 to 6_2400, and the source lines S601 to S1200 are driven by the drive signals with the voltage levels.

As described above, the selector 1 sequentially transfers the image data extracted from the slot 4_1 to the latches 5_1 to 5_600 and the latches 5_1801 to 5_2400, and thereby the drive signals based on the image data R1 to R800, G1 to G800, and B1 to B800 which are received via the port Port_1 are output to the source lines S1 to S1200 via the pads 14_1 and 14_4.

In contrast, in order to left-right reverse the displayed image, the selector 1 sequentially transfers the image data extracted from the slot 4_1 to the latches 5_2400 to 5_1201 and the latches 5_600 to 5_1 in reverse order to the above, and thereby the drive signals based on the image data R1 to R800, G1 to G800, and B1 to B800 which are received via the port Port_1 are output to the source lines S2400 to S1801 and S600 to S1.

As a result, by controlling the selector 1, it is possible to display the image data by reversing the left and right of the image, by maintaining as is the output ports or the output sequence of the image data output from the host processor 30.

As described above, the liquid crystal display driver IC 10 according to the present invention can have versatility with regard to the number of parallel communication channels which are connected to the host processor 30 and the resolution of the drivable display panel 20, without damaging a function of left-right reversing the display image. That is, it is possible to freely configure the transfer channels of the image data from the required number of communication interface circuits (DSI_1 to DSI_m) 3_1 to **3_*m* among the plurality of communication interface circuits to the driving circuits 6_1 to 6_*n*** for driving source lines at desired positions, and it is possible to freely relate the number of communication interface circuits being used, that is, the number of ports, and the number and position of the source lines being driven.

Second Embodiment

Input Side Selector

A new problem which occurs in a case where the host processor 30 and the liquid crystal display driver IC 10 are connected in parallel by using the plurality of communication channels and which is found by the inventor of the present application will be described.

The host processor 30 generally transfers a control command to the liquid crystal display driver IC 10, controls an operation of the liquid crystal display driver IC 10 by setting an appropriate parameter in a control register provided therein, and in addition, monitors an operation state of the liquid crystal display driver IC 10 by reading out data from an internal status register. Such communication is implemented using the same communication channel, prior to the transfer of the image data, or by being time-shared with the transfer of the image data. In a case where the plurality of communication channels are provided in parallel between the host processor 30 and the liquid crystal display driver IC 10, the communication for the control described above may be implemented using only any one communication channel. At this time, the port through which the host processor 30 performs the communication for control is called a master port, and the other ports are called slave ports. In the liquid crystal display driver IC 10, it is necessary for the communication interface 3 connected to the master port to connect to the slot 4 which is configured to include not only the data adaptor which extracts the image data but also the command adaptor which can extract the control command described above. Such a port of the liquid crystal display driver IC 10 is set as port Port_1, and it is set so that the command adaptor is not connected to the other ports. It is generally considered that in the liquid crystal display driver IC 10, a series of pads 13 which are connected to the communication ports are arranged collectively in sequential order for each port at a side opposite to the side on which the pads 14 connected to the source lines are arranged. Hereinafter, an example of a case where the liquid crystal display driver IC 10 includes two communication ports will be described.

Figure 5:
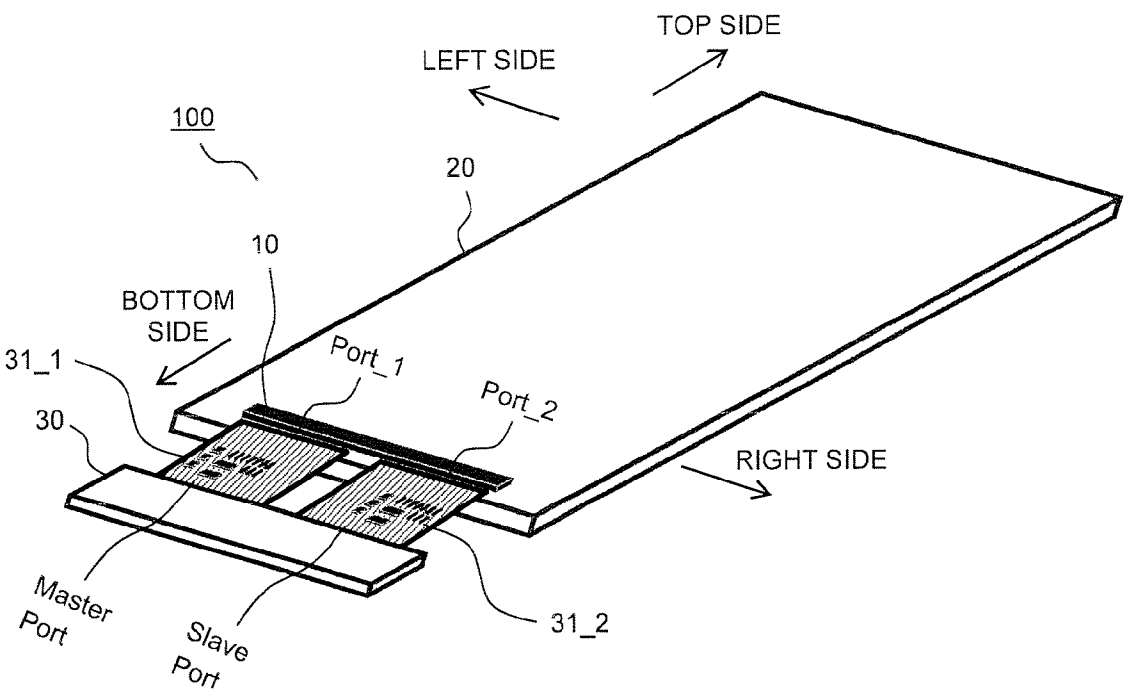
FIG. 5 is a perspective view which illustrates the liquid crystal display device 100 in accordance with one connection example of the liquid crystal display driver IC (two ports), the host processor, and the display panel, according to the present invention, and which illustrates a state in which the liquid crystal display driver IC is embedded on a side near the host processor of the display panel.

FIG. 5 is a perspective view which illustrates the liquid crystal display device 100 in accordance with one connection example of the liquid crystal display driver IC 10, the host processor 30, and the display panel 20, according to the present invention, and which illustrates a state in which the liquid crystal display driver IC 10 is mounted on a side, near the host processor 30, of the display panel 20. The liquid crystal display driver IC 10 is mounted on a bottom side of the liquid crystal display panel 20, for example, in a flip-chip type, and is connected to the host processor 30 by flexible printed circuit boards 31_1 and 31_2. The pads 14 to be connected to the source lines are arranged on top side of the liquid crystal display driver IC 10 and are wired to the source lines of the display panel 20, and the pads of the port Port_1 and the port Port_2 to be connected to the communication channels are arranged the bottom side. The master port is arranged on a left side of the host processor 30, and the port Port_1 connected to the master port is arranged similarly on the left side.

In contrast, it is considered that even in a combination of the liquid crystal display driver IC 10, the host processor 30, and the display panel 20 which are the same as above, the liquid crystal display driver IC 10 is mounted on the top side, which is a side opposite to the host processor 30, of the display panel 20.

Figure 6:
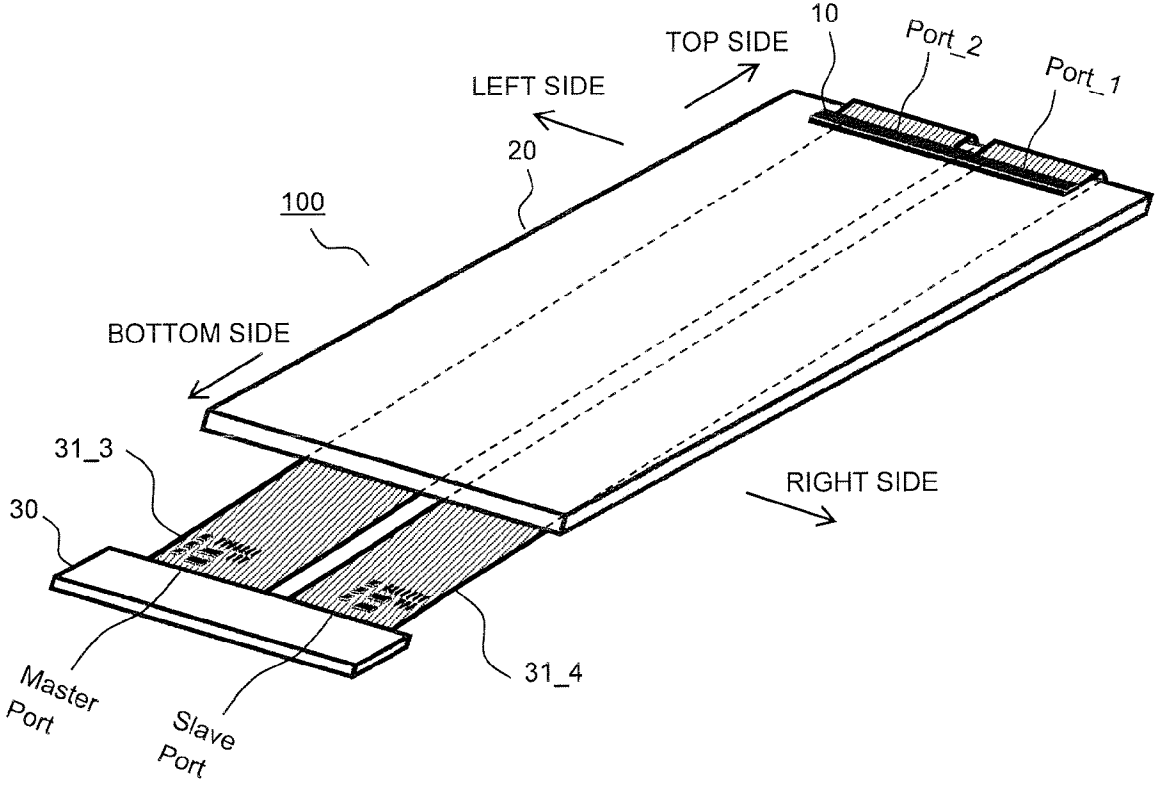
FIG. 6 is a perspective view which illustrates the liquid crystal display device 100 in accordance with another connection example of the liquid crystal display driver IC (two ports), the host processor, and the display panel, according to the present invention, and which illustrates a state in which the liquid crystal display driver IC is embedded on a side far from the host processor of the display panel.

FIG. 6 is a perspective view which illustrates the liquid crystal display device 100 in accordance with another connection example of the liquid crystal display driver IC (two ports) 10, the host processor 30, and the display panel 20, according to the present invention, and which illustrates a state in which the liquid crystal display driver IC 10 is mounted on a side far from the host processor 30 of the display panel 20. The liquid crystal display driver IC 10 is mounted on the top side of the liquid crystal display panel 20, for example, in a flip-chip type, and is connected to the host processor 30 by flexible printed circuit boards 31_3 and 31_4. The pads 14 to be connected to the source lines are arranged on the bottom side of the liquid crystal display driver IC 10 and are wired to the source lines of the display panel 20, and the pads of the port Port_1 and the port Port_2 which are connected to the communication channels are arranged on the top side. Compared with a case of FIG. 5, the liquid crystal display driver IC 10 is mounted by 180° rotation, and thus the port Port_1 is arranged on the right side, and the port Port_2 is arranged on the left side. In contrast, the host processor 30 is mounted in the same direction as that in FIG. 5, the master port is arranged on the left side of the display panel 20, and the slave port is arranged on the right side of the display panel 20. Since an intersection of the flexible printed circuit boards 31_3 and 31_4 is not allowed for mounting in most cases, the master port of the host processor 30 is connected to the port Port_2 of the liquid crystal display driver IC 10 by the flexible printed circuit board 31_3, and the slave port is connected to the port Port_1 of the liquid crystal display driver IC 10 by the flexible printed circuit board 31_4.

If the slots 4 configured to include the command adaptors are connected only to the port Port_1 of the liquid crystal display driver IC 10, there is a problem that in a case of FIG. 6, the liquid crystal display driver IC 10 cannot receive appropriately the control command transferred from the master port of the host processor 30.

A function of left-right reversing an arrangement of a plurality of arranged pads within a range of ports of one system is stipulated in MIPI/DSI, but a case where the plurality of ports is connected in parallel is not particularly considered.

Figure 7:
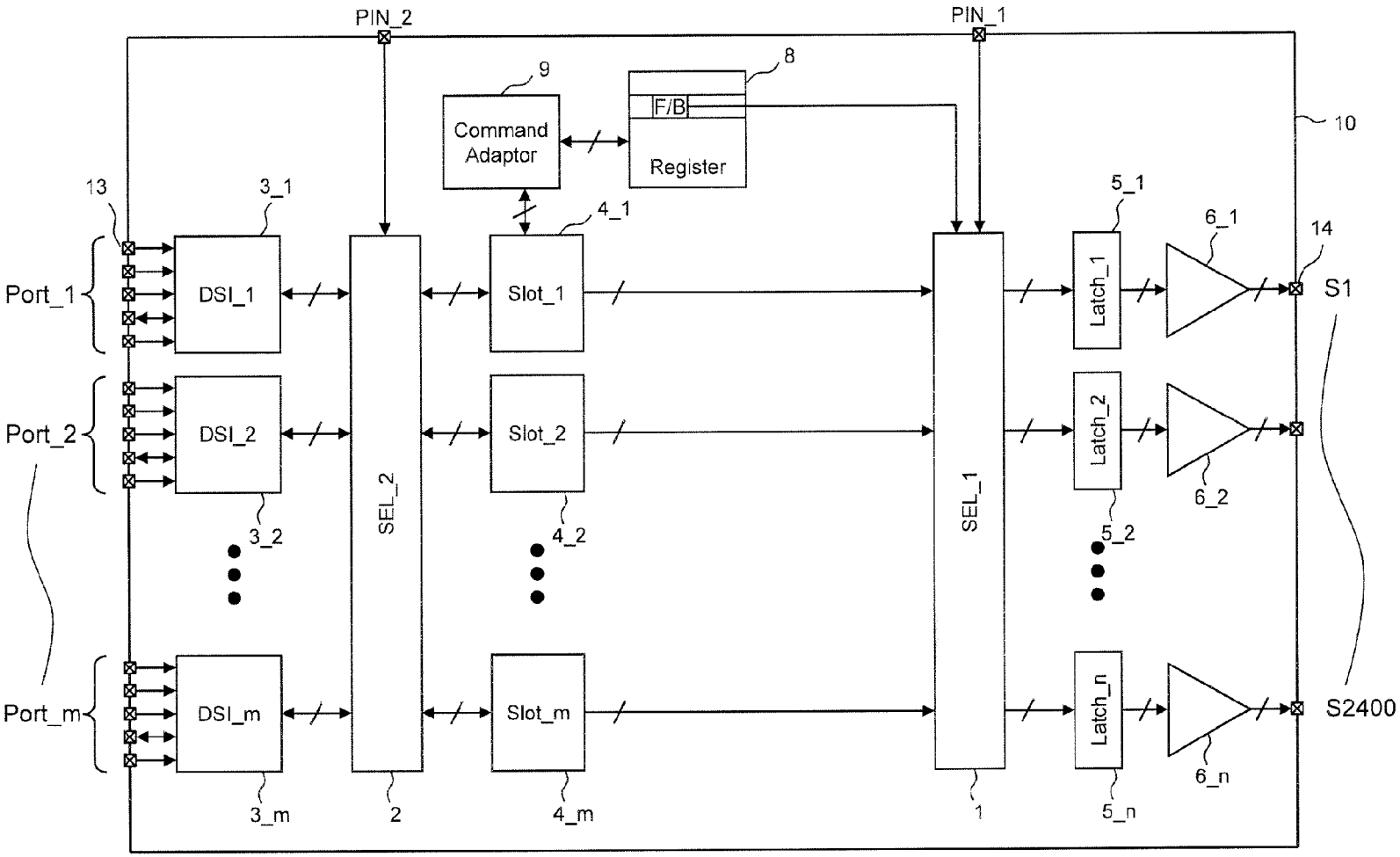
FIG. 7 is a block diagram illustrating a configuration of a liquid crystal display driver IC according to a second embodiment.

FIG. 7 is a block diagram illustrating a configuration of a liquid crystal display driver IC according to a second embodiment.

In addition to the configuration of the liquid crystal display driver IC 10 illustrated in FIG. 1, the liquid crystal display driver IC 10 according to the embodiment further includes an input side selector 2 and a command adaptor 9 and a control register 8. In order to avoid confusion, the selector 1 described in the first embodiment is hereinafter referred to as an output side selector 1.

Since the liquid crystal display driver IC 10 can be connected in parallel by using the plurality of communication channels, the liquid crystal display driver IC 10 includes the plurality of ports Port_1 to Port_m, and the communication interface circuits (DSI_1 to DSI_m) 3_1 to **3_*m* are provided in each port. The data adaptors are embedded in the slots (Slot_1 to Slot_m) 4_1 to 4_*m*, respectively, and the command adaptor 9 is further connected to the slot (Slot_1) 4_1 among the slots (Slot_1 to Slot_m) 4_1 to 4_*m*. The control register 8 is connected to the command adaptor 9, and differently from in the first embodiment, the liquid crystal display driver IC 10 includes an input side selector (SEL_2) 2 between the communication interface circuits (DSI_1 to DSI_m) 3_1 to 3_*m* and the slots (Slot_1 to Slot_m) 4_1 to 4_*m*. The input side selector 2 is configured to be able to select to which slot each of a plurality of image data outputs respectively received from the communication interface circuits (DSI_1 to DSI_m) 3_1 to 3_*m* is supplied, among the slots (Slot_1 to Slot_m) 4_1 to 4_*m*. Video adaptors embedded in the slots (Slot_1 to Slot_m) 4_1 to 4_*m* extract the image data from the received data and supply to the output side selector 1. The command adaptor 9 is connected to at least one, which is the slot (Slot_1) 4_1 in FIG. 7, of the plurality of slots (Slot_1 to Slot_m) 4_1 to 4_*m*, extracts a command from the received data by the communication interface (any one of the slots DSI_1 to DSI_m) selected by the input side selector 2, and sets the value based on the extracted command in the register 8. The control register 8 may be configured to include status information, and when receiving a command leading the status information, the command adaptor 9 may read out the status information from the control register 8, and may be configured to be able to respond to the host processor 30 via the communication interface (any one of the slots DSI_1 to DSI_m) selected by the input side selector 2. The status information may include a different status register, without being included in the control register 8**.

The output side selector 1 is configured to be able to select to which one of the plurality of latches 5_1 to **5_*n* each of the plurality of image data outputs respectively extracted by the video adaptor embedded in the slots (Slot_1 to Slot_m) 4_1 to 4_*m* is supplied, based on the value (for example, F/B) set in the control register 8. In addition to the value (for example, F/B) set in the control register 8, a control signal which performs a selection control of the output side selector 1 may be supplied from a terminal PIN_1 of the liquid crystal display driver. IC 10**.

By providing the input side selector 2, it is possible to freely switch a relationship between the communication channel through which the host processor 30 transfers the command, and the video adaptor 9 which can extract the command and reflect the content of the command in the control register 8 of the liquid crystal display driver IC 10. Even in a case where a positional relationship for embedding between the host processor 30 and the liquid crystal display driver IC 10 is rotated by 180°, it is possible to connect without intersection of the communication channels using, for example, the flexible printed circuit board.

The input side selector 2 is configured to be able to select to which slot the data received from one of the communication interface circuits (DSI_1 to DSI_m) 3_1 to **3_*m* is supplied among the slots (Slot_1 to Slot_m) 4_1 to 4_*m*, based on the value set in the terminal PIN_2. As a result, by fixing the terminal when embedded in the display panel 20, a communication channel through which the data including the commands from the plurality of communication channels connected to the liquid crystal display driver IC 10 is transmitted is selected, and thereby the input side selector 2** can be controlled so as to be connected to the slot which is connected to the command adaptor.

Figure 8:
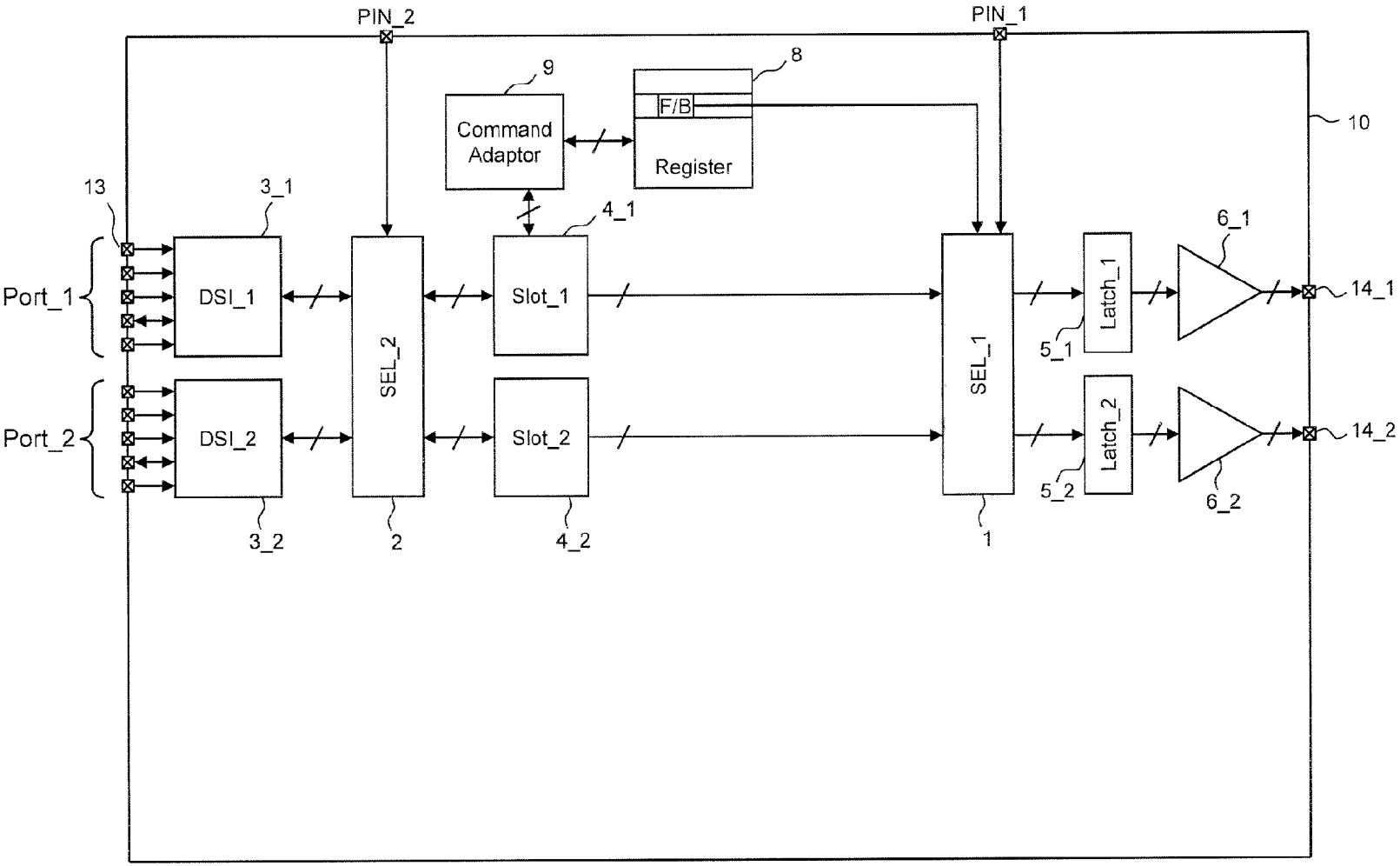
FIG. 8 is a block diagram illustrating a configuration example (two ports) of the liquid crystal display driver IC according to the second embodiment.

FIG. 8 is a block diagram illustrating a configuration example (two ports) of the liquid crystal display driver IC according to the second embodiment.

The liquid crystal display driver IC 10 includes two ports Port_1 and Port_2, and the communication interface circuits (DSI_1 and DSI_2) 3_1 and 3_2 are provided to each port. The slots 4_1 and 4_2 embed data adaptors, respectively, and the command adaptor 9 is further connected to the slot 4_1 of the slots 4_1 and 4_2, and the control register 8 is connected to the command adaptor 9. The input side selector 2 is provided between the communication interface circuits (DSI_1 and DSI_2) 3_1 and 3_2 and the slots 4_1 and 4_2, and by the terminal PIN_2, it is controlled so as to select which one of the communication interface circuits (DSI_1 and DSI_2) 3_1 and 3_2 is connected to the slot 4_1 to which the command adaptor 9 is connected. Since it is clear at a design step that which one of the two ports Port_1 and Port_2 is a port which enables the master port of the host processor 30 to be connected to the flexible printed circuit board without intersecting with each other or the like, a value of logic fixing of the terminal PIN_2 is designated at the step.

In the same manner as exemplified so far, the liquid crystal display driver IC 10 includes 2400 pieces of output pads 14, 2400 pieces of driving circuits 6, and 2400 pieces of latches 5, in such a manner that, for example, 2400 pieces of source lines can be driven. In FIG. 8, 2400 pieces of source lines are divided into two groups of S1 to S1200 and S1201 and S2400, and the liquid crystal display driver IC 10 includes 1200 pieces of output pads 141, 1200 pieces of driving circuits 6_1 and 1200 pieces of latches 5_1 for driving S1 to S1200, and includes 1200 pieces of output pads 14_2, 1200 pieces of driving circuits 6_2 and 1200 pieces of latches 5_2 for driving S1201 to S2400. By dividing into two groups, the output side selector 1 can be configured as a simple circuit. It is sufficient to control four basic ways by combining two ways of writing the image data extracted from the slots (Slot_1 and Slot_2) 4_1 and 4_2 to the latch 5_1 or to the latch 5_2, and two ways of writing the image data in input sequence without the left-right reversing or writing in reverse sequence in order to left-right reverse. For example, in order for the connected display panel 20 to be able to adapt to a plurality of sizes (resolutions), a necessary control based on the four ways may be added.

Third Embodiment

Pixel Data Counter on Input Side

Figure 9:
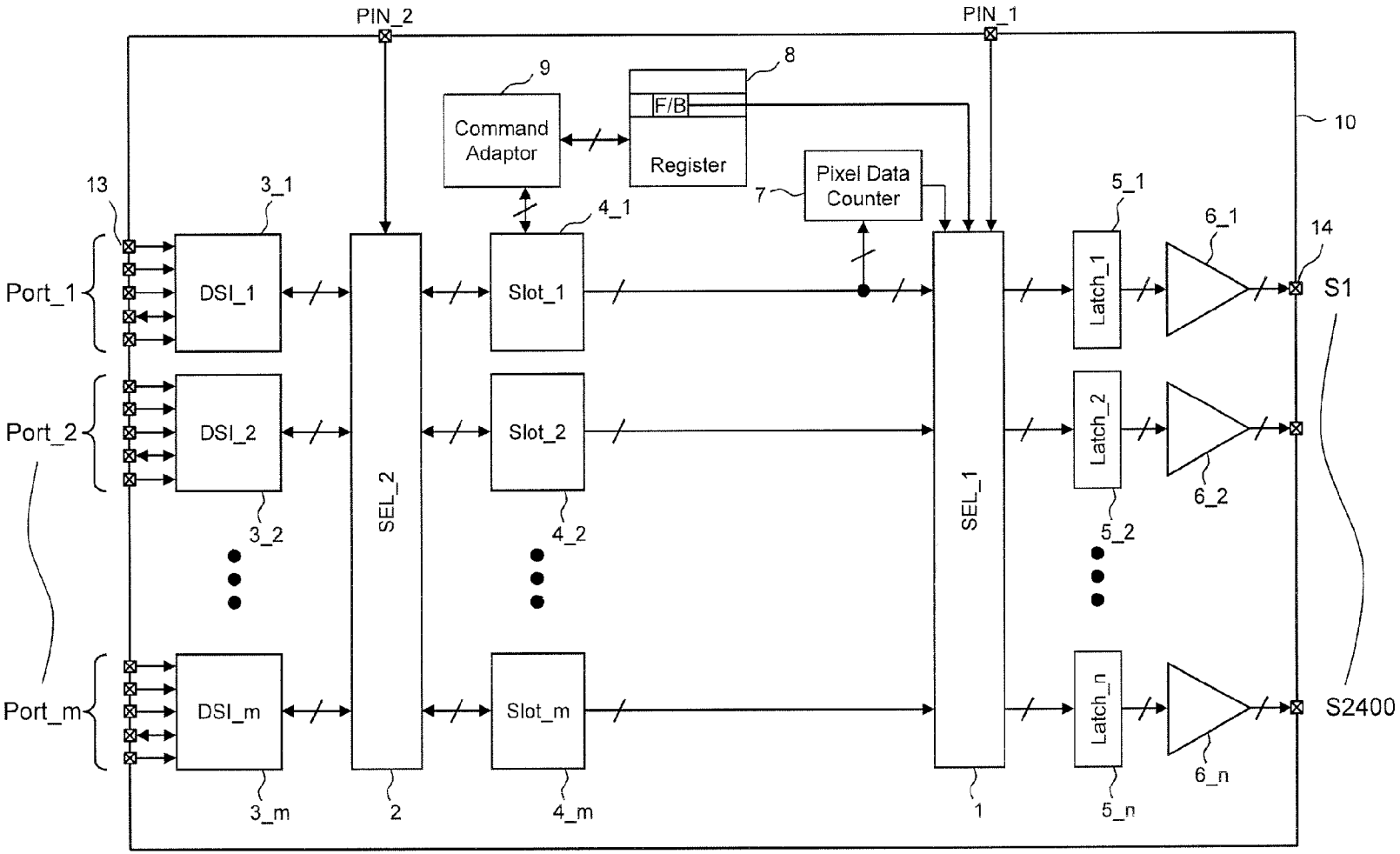
FIG. 9 is a block diagram illustrating a configuration of a liquid crystal display driver IC according to a third embodiment.

FIG. 9 is a block diagram illustrating a configuration of a liquid crystal display driver IC 10 according to a third embodiment. In addition to the configuration of the liquid crystal display driver. IC 10 according to the second embodiment illustrated in FIG. 7, a pixel data counter 7 is provided in the liquid crystal display driver IC 10. The other configuration is the same as those described by referring to FIG. 7 with regard to the second embodiment, and thereby description thereof will not be repeated. The pixel data counter 7 is connected to the output of the slot (Slot_1) 4_1, and counts the number of pieces of image data output from the slot (Slot_1) 4_1, and when reaching a predetermined number, controls the output side selector 1 by asserting the control signal.

As a result, even in a case where the number of communication interfaces used for obtaining a necessary bandwidth is smaller than the number of communication interfaces included in the liquid crystal display driver IC 10, it is possible to select a position to be displayed according to the sequence being input with regard to the image data received from the communication interface circuit (slot (Slot_1) 4_1 in FIG. 9) which is connected to the pixel data counter 7.

For example, there is a case where the resolution of the connected display panel is low. In this case, the number of communication interfaces used for obtaining the necessary band-width is smaller than the number of communication interfaces included in the liquid crystal display driver IC 10. In addition, the number of source lines to be driven is smaller than the number of the driving circuits included in the liquid crystal display driver IC 10. In this way, in a case where the display panel with a low resolution is connected, it is possible to arbitrarily set the position of the driving circuit connected to the source line of the connected display panel.

For example, in the same manner as that of the liquid crystal display device 100 exemplified in FIG. 4, only one of the four ports of the communication interface which are included in the liquid crystal display driver IC 10 is used, and it is available in a case where, among 2400 pieces of pads 14_1 to 14_4 for driving 2400 pieces of source lines, a total of 1200 pieces of pads 14_1 and 14_4 which are the sum of two pad groups on both ends, each group being 600 pieces, are connected to be used to the display panel 20 with 800 RGB. The image data R1 to R800, G1 to G800, and B1 to B800 input from the port Port_1 are transferred by using all of the port Port_1. Among the image data, the image data R1 to R400, G1 to G400, and B1 to B400 are sequentially written to the latches 5_1 to 5_600 via the output side selector 1, and then output from the driving circuits 6_1 to 6_600. The image data R401 to R800, G401 to G800, and B401 to B800 are sequentially written to the latches 5_1801 to 5_2400 via the output side selector 1, and then output from the driving circuits 6_1801 to 6_2400. For example, if the latches 5, the driving circuits 6, and the pads 14 are controlled by being divided into four groups each having 600 pieces, the control of the output side selector 1 is simplified. The latches 5 are divided into four groups of 5_1 to 5_600, 5_601 to 5_1200, 5_1201 to 5_1800, and 5_1801 to 5_2400, and the output side selector 1 may be selectively controlled so as to output to one of the first to fourth groups. At this time, in the example described above, when the count values of the image data performed by the pixel data counter 7 are R1 to R400, G1 to G400, and B1 to B400, it is controlled so as to output to the first group from the output side selector 1. After that, when exceeding 400 RGB, the control signal of the output side selector 1 is switched, and the image data R401 to R800, G401 to G800, and B401 to B800 are controlled so as to be output to the latches 5_1801 to 5_2400 of the fourth group. When the output side is divided into four groups as described above, the control signal for selecting an output destination requires only two bits, and the control circuit is simplified. In a case where the output side is divided into more than four groups, the control of the output side selector 1 becomes a little complicated, but a degree of freedom of selection of the used output pads is improved. The pixel data counter 7 is provided, and by switching the output destination of the output side selector 1 while a series of image data is input from one port, the degree of freedom of selection of the used output pads can be improved. An example in which the pixel data counter 7 is provided to only one port is illustrated, but the pixel data counter 7 may be provided to a plurality of ports.

A different effect according to the provided pixel data counter 7 will be described. It is similar even in a case where in order to compress to transmit the image data over the communication channel, the number of the used communication interface circuits is smaller than the number of the communication interfaces included in the liquid crystal display driver IC. In a case where the resolution of the connected display panel 20 is low, the degree of freedom of selection of the used output pads can be improved.

Figure 10:
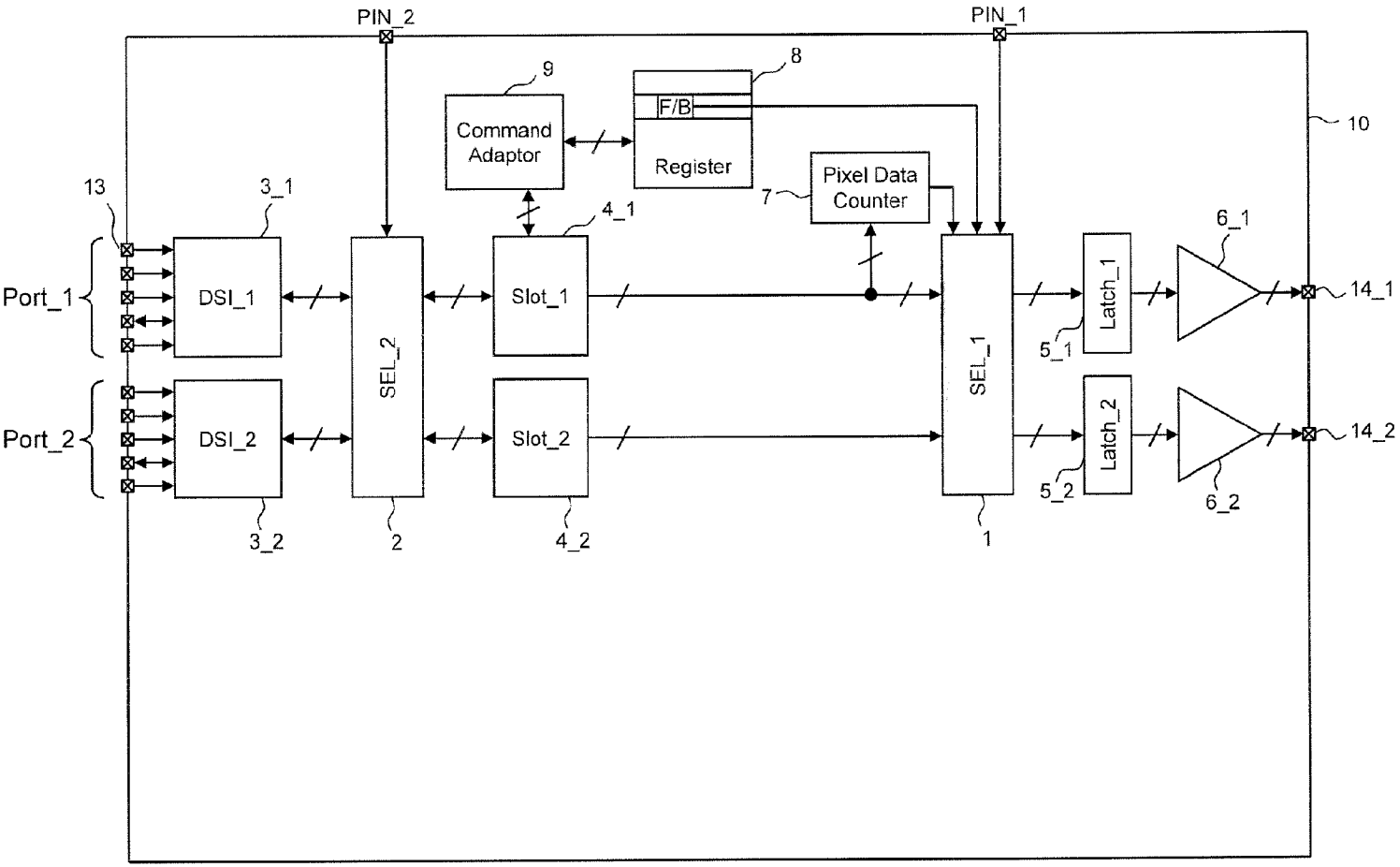
FIG. 10 is a block diagram illustrating a configuration example (two ports) of the liquid crystal display driver IC according to the third embodiment.

FIG. 10 is a block diagram illustrating a configuration example (two ports) of the liquid crystal display driver IC according to the third embodiment. In addition to the configuration of the liquid crystal display driver IC 10 according to the second embodiment illustrated in FIG. 8, the pixel data counter 7 is provided. The other configuration is the same as that described by referring to FIG. 8 with regard to the second embodiment, and thereby description thereof will not be repeated. The pixel data counter 7 is connected to the output of the slot (Slot_1) 4_1, and counts the number of pieces of image data output from the slot (Slot_1) 4_1, and when reaching a predetermined number, the output side selector 1 is controlled by asserting the control signal. In the same manner as in FIG. 8, an example in which the output of the output side selector 1 is divided into two groups is illustrated. That is, 2400 pieces of source lines are divided into two groups of S1 to S1200 and S1201 to S2400, and the liquid crystal display driver IC 10 includes 1200 pieces of output pads 14_1, 1200 pieces of driving circuits 6_1 and 1200 pieces of latches 5_1 for driving S1 to S1200, and includes 1200 pieces of output pads 14_2, 1200 pieces of driving circuits 6_2 and 1200 pieces of latches 5_2 for driving S1201 to S2400. By dividing the source lines into further groups, the degree of freedom of selection of the output side selector 1 can be improved.

FIG. 11 is a truth table for explaining an example of a switching operation of an input side selector 2 performed by the terminal PIN_2. When the terminal PIN_2 is "0", the communication interface circuit (DSI_1) 3_1 is connected to the slot (Slot_1) 4_1, and the communication interface circuit (DSI_2) 3_2 is connected to the slot (Slot_2) 4_2. When the terminal PIN_2 is "1", the communication interface circuit (DSI_2) 3_2 is connected to the slot (Slot_1) 4_1, and the communication interface circuit (DSI_1) 3_1 is connected to the slot (Slot_2) 4_2.

In the same manner as described in the second embodiment, by fixing the terminal PIN_2 when embedded in the display panel 20, a communication channel through which the data including the commands from the communication channels of two systems connected to the liquid crystal display driver IC 10 is transmitted is selected, and thereby the input side selector 2 can be controlled so as to be connected to the slot (Slot_1) 4_1 which is connected to the command adaptor. As a result, even in a case where a positional relationship for embedding between the host processor 30 and the liquid crystal display driver IC 10 is rotated by 180°, it is possible to connect without intersection of the communication channels using, for example, the flexible printed circuit board.

FIG. 12 is a truth table for explaining an example of a switching operation of an output side selector 1 performed by the terminal PIN_1. The number of used input ports is designated by the terminal PIN_1. In a case where two ports are used, PIN_1 is set to "0", and in a case where only one port is used, PIN_1 is set to "1". Whether or not to perform the left-right reversing of the image is set by an F/B bit set in the control register 8. When the left-right reversing is performed, the F/B bit is set to "1", and when the left-right reversing is not performed, the F/B bit is set to "0".

When F/B=0 at PIN_2=0 and PIN_1=0, the image data input from the communication interface circuit (DSI_1) 3_1 is written to the latch 5_1 via the slot (Slot_1) 4_1, and the image data input from the communication interface circuit (DSI_2) 3_2 is written to the latch 5_2 via the slot (Slot_2) 4_2. When the F/B bit which performs the left-right reversing equals "1" (F/B=1), the output side selector 2 is switched, and thereby the image data input from the communication interface circuit (DSI_1) 3_1 is written to the latch 5_2 via the slot (Slot_1) 4_1, and the image data input from the communication interface circuit (DSI_2) 3_2 is written to the latch 5_1 via the slot (Slot_2) 4_2. In contrast, when F/B=0 at PIN_2=1 and PIN_1=0, the image data input from the communication interface circuit (DSI_2) 3_2 is written to the latch 5_1 via the slot (Slot_1) 4_1, and the image data input from the communication interface circuit (DSI_1) 3_1 is written to the latch 5_2 via the slot (Slot_2) 4_2. When the F/B bit which performs the left-right reversing equals "1" (F/B=1), the output side selector 2 is switched, and thereby the image data input from the communication interface circuit (DSI_2) 3_2 is written to the latch 5_2 via the slot (Slot_1) 4_1, and the image data input from the communication interface circuit (DSI_1) 3_1 is written to the latch 5_1 via the slot (Slot_2) 4_2.

In a case where PIN_1 is set to "1" and only one port is used, and when F/B=0 at PIN_2=0, the image data input from the communication interface circuit (DSI_1) 3_1 is written to the latch 5_1 via the slot (Slot_1) 4_1, while the count value of the pixel data counter 7 is smaller than RGB1201, and the image data is written to the latch 5_2 while the count value of the pixel data counter 7 is equal to or larger than RGB1201. In contrast, when the F/B bit which performs the left-right reversing equals "1" (F/B=1) at PIN_2=0, the image data input from the communication interface circuit (DSI_1) 3_1 is written to the latch 5_2 via the slot (Slot_1) 4_1, while the count value of the pixel data counter 7 is smaller than RGB1201, and the image data is written to the latch 5_1 while the count value of the pixel data counter 7 is equal to or larger than RGB1201. In addition, when F/B=0 at PIN_2=1, the image data input from the communication interface circuit (DSI_2) 3_2 is written to the latch 5_1 via the slot (Slot_1) 4_1, while the count value of the pixel data counter 7 is smaller than RGB1201, and the image data is written to the latch 5_2 if the count value of the pixel data counter 7 is equal to or larger than RGB1201. In contrast, when the F/B bit which performs the left-right reversing equals "1" (F/B=1) at PIN_2=0, the image data is written to the latch 5_1, while the count value of the pixel data counter 7 is smaller than RGB1201.

As described above, the setting of "1" or "0" set in the truth table is just an example, and it may be a different setting, or may be positive logic or negative logic.

Fourth Embodiment

Liquid Crystal Display Driver IC with Embedded RAM

Figure 13:
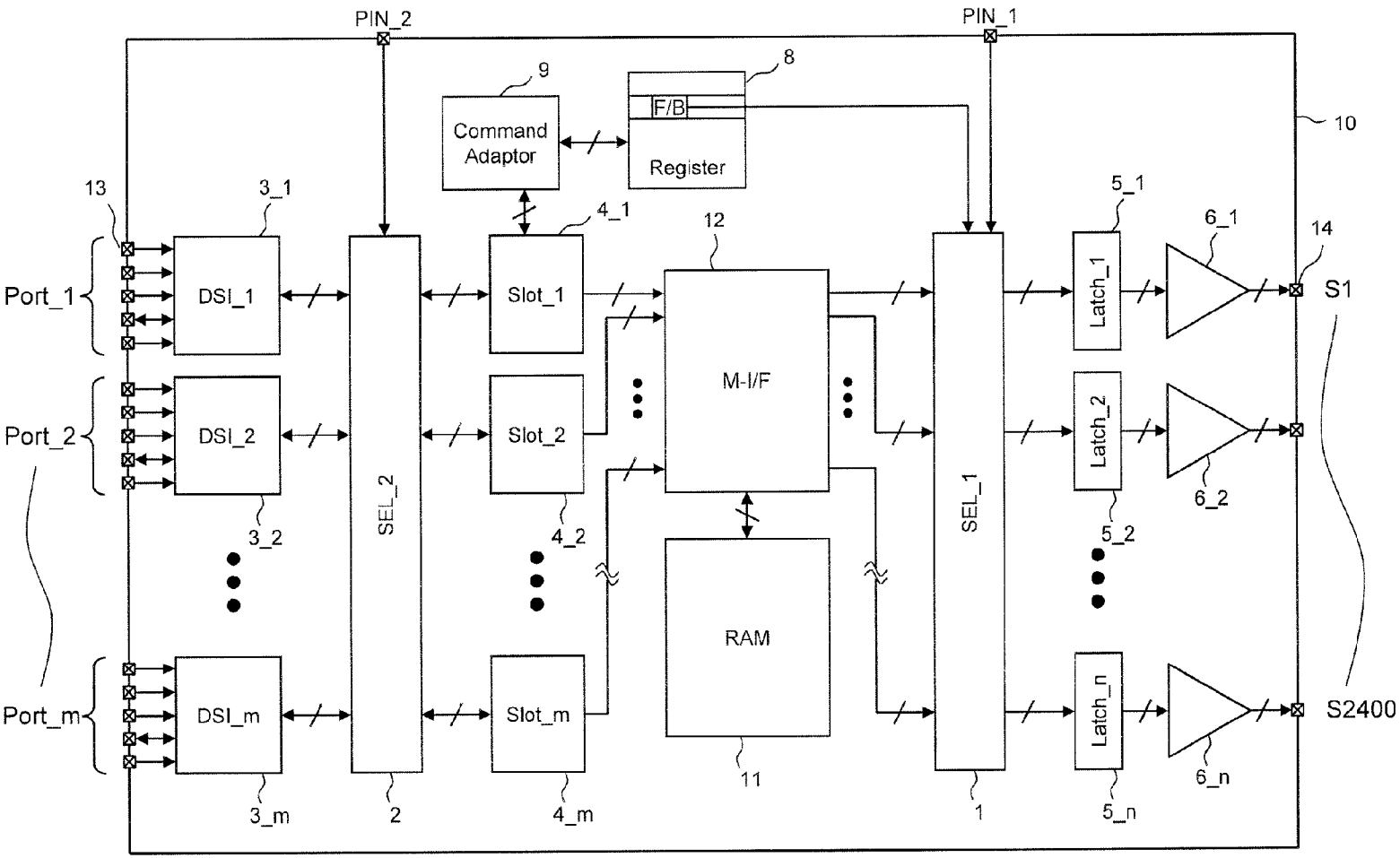
FIG. 13 is a block diagram illustrating a configuration of a liquid crystal display driver IC with an embedded RAM according to a fourth embodiment.

FIG. 13 is a block diagram illustrating a configuration of a liquid crystal display driver IC with an embedded RAM according to a fourth embodiment. In addition to the configuration of the liquid crystal display driver IC 10 according to the second embodiment illustrated in FIG. 7, a RAM 11 and memory interface 12 are provided. The memory interface 12 writes the image data input from the slots (Slot_1 to Slot_m) 4_1 to **4_*m* to the RAM 11, reads out the written image data from the RAM 11, and supplies the read image data to the output side selector 1. The other configuration is the same as that described by referring to FIG. 7 with regard to the second embodiment, and thereby description thereof will not be repeated. The RAM 11 functions as a frame memory of the image. For example, it is possible to provide a function such as displaying by repeatedly reading out the image data of a still image which is once transferred and stored in the RAM 11**.

Figure 14:
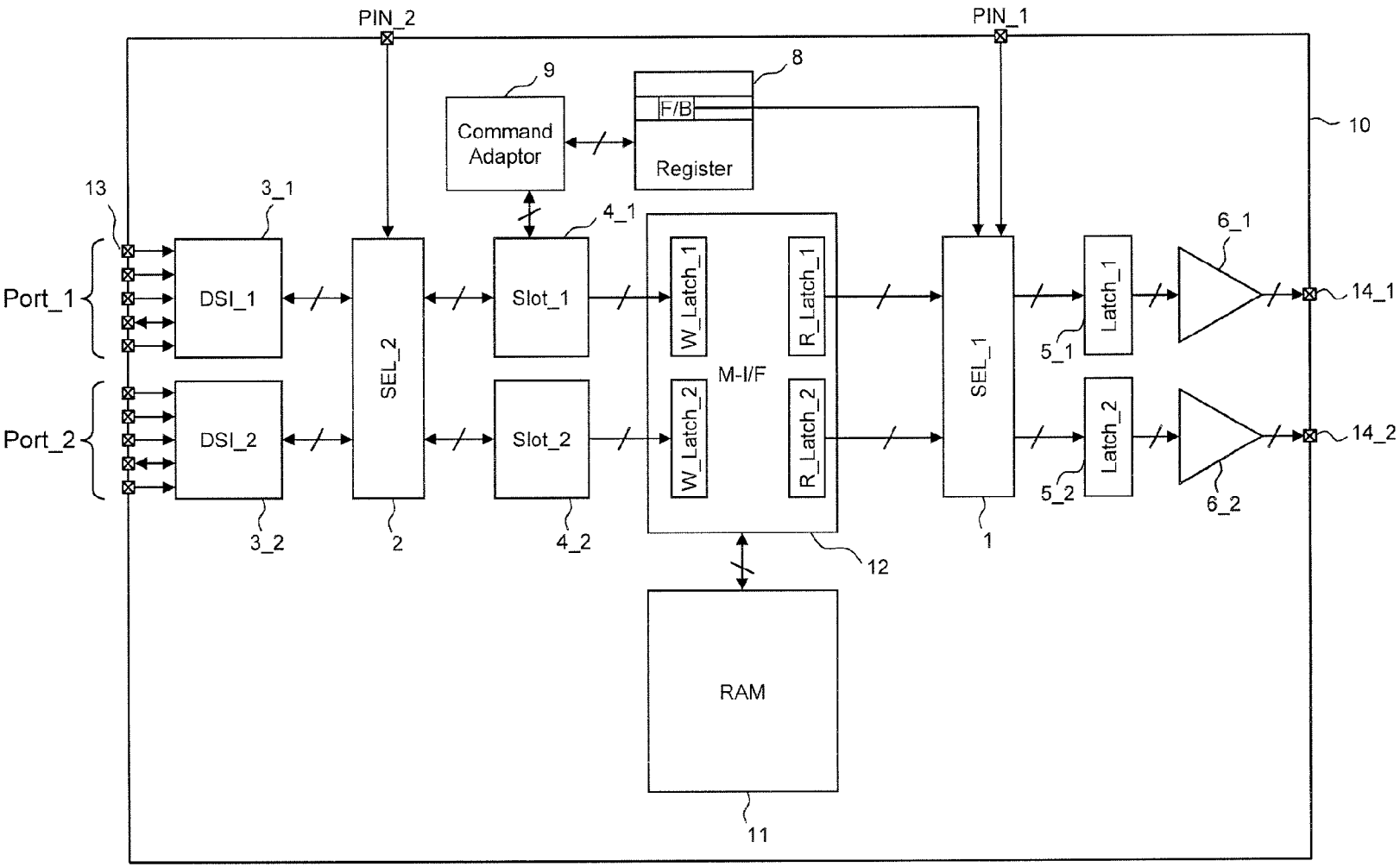
FIG. 14 is a block diagram illustrating a configuration example (two ports) of the liquid crystal display driver IC with the embedded RAM according to the fourth embodiment.

FIG. 14 is a block diagram illustrating a configuration example (two ports) of the liquid crystal display driver IC with the embedded RAM according to the fourth embodiment. In addition to the configuration of the liquid crystal display driver IC 10 according to the second embodiment illustrated in FIG. 8, the RAM 11 and the memory interface 12 are provided. The other configuration is the same as that described by referring to FIG. 8 with regard to the second embodiment, and thereby description thereof will not be repeated. The memory interface 12 includes writing latches W_latch_1 and W_latch_2, and reading latches R_latch_1 and R_latch_2. The memory interface 12 temporarily writes the image data input from the slots (Slot_1 and Slot_2) 4_1 and 4_2 to the writing latches W_latch_1 and W_latch_2, and then writes to RAM 11. Also, the memory interface 12 reads out the written image data from the RAM 11 to the reading latches R_latch_1 and R_latch_2, and then supplies the data to the output side selector 1.

As a result, it is possible to provide a liquid crystal display driver having the same effect as the liquid crystal display driver IC described in the above-described second embodiment, even with regard to the liquid crystal display driver IC 10 in which the RAM 11 is embedded as a frame memory.

Figure 15:
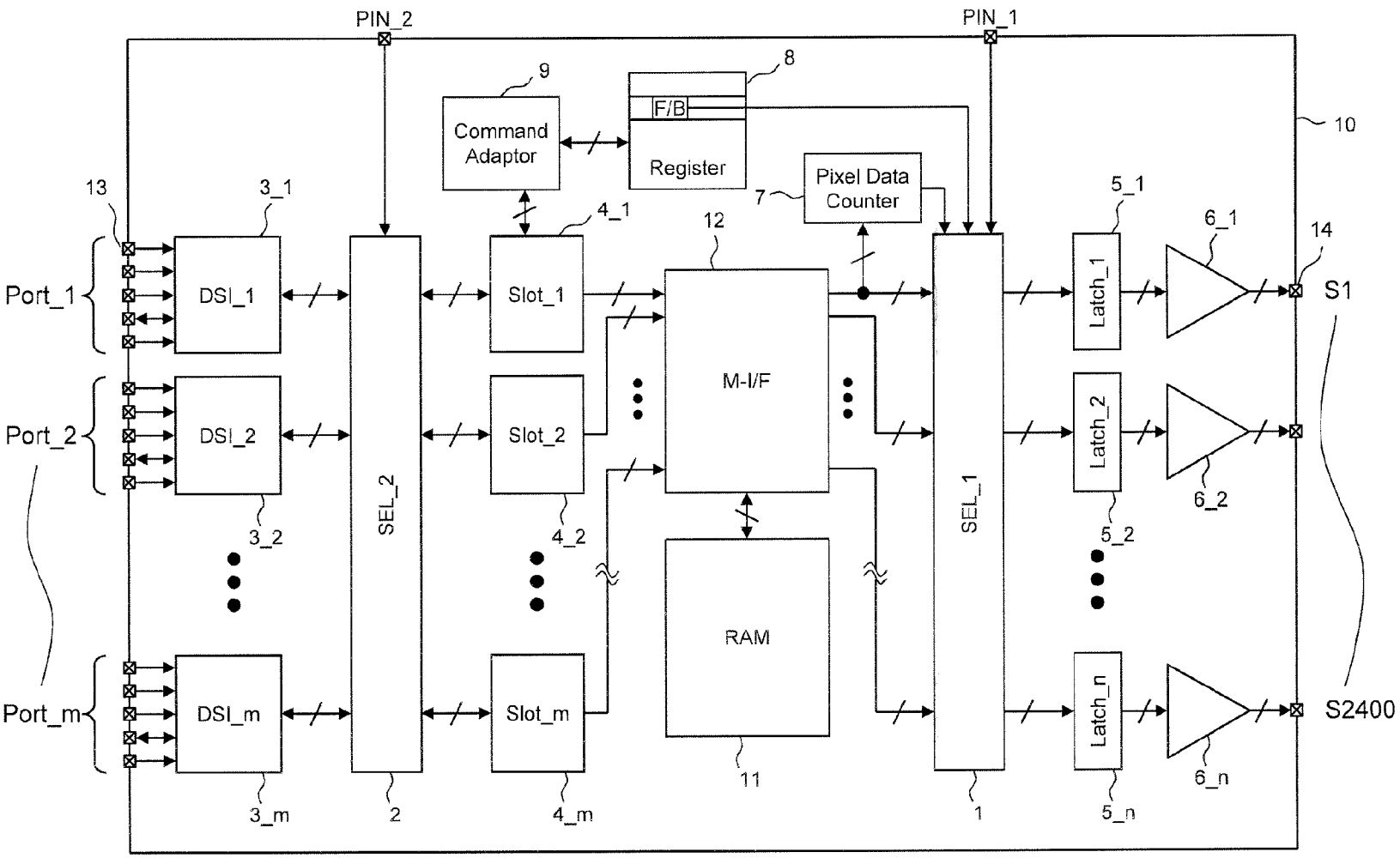
FIG. 15 is a block diagram illustrating a configuration of a liquid crystal display driver IC with the embedded RAM and a mounted pixel data counter according to the fourth embodiment.

FIG. 15 is a block diagram illustrating a configuration of a liquid crystal display driver IC with the embedded RAM and the mounted pixel data counter according to the fourth embodiment. In addition to the configuration of the liquid crystal display driver IC 10 described above by referring to FIG. 13, a pixel data counter 7 is provided. The other configuration is the same as that described above, and thereby description thereof will not be repeated. The pixel data counter 7 is connected to the output of the memory interface 12, counts the number of pieces of image data output from one or a plurality of output channels thereof, and when reaching the predetermined number, controls the output side selector 1 by asserting the control signal.

Figure 16:
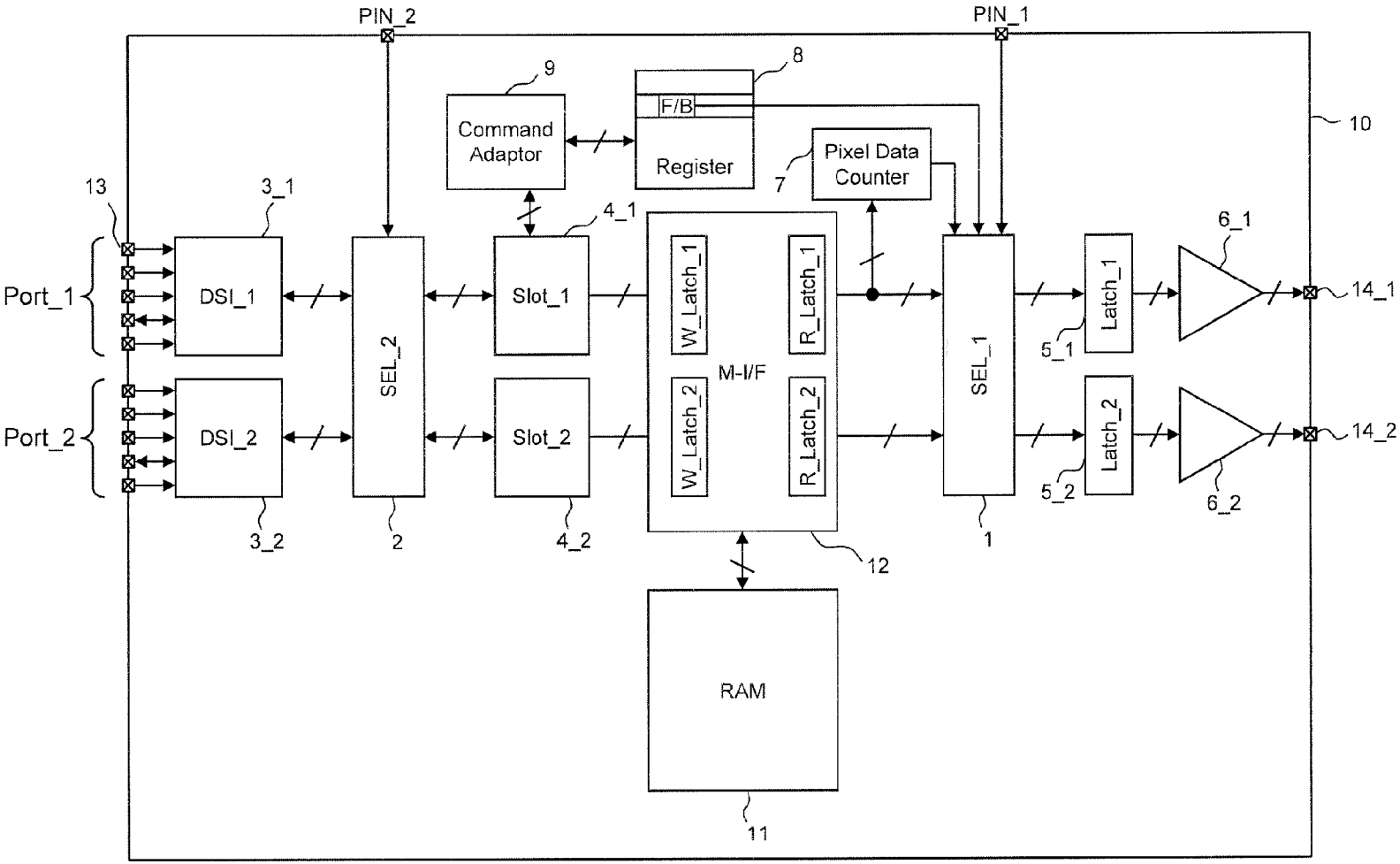
FIG. 16 is a block diagram illustrating a configuration example (two ports) of the liquid crystal display driver IC with the embedded RAM and the mounted pixel data counter according to the fourth embodiment.

FIG. 16 is a block diagram illustrating a configuration example (two ports) of the liquid crystal display driver IC with the embedded RAM and the mounted pixel data counter according to the fourth embodiment. In addition to the configuration of the liquid crystal display driver IC 10 described above by referring to FIG. 14, a pixel data counter 7 is provided. The other configuration is the same as that described above, and thereby description thereof will not be repeated. The pixel data counter 7 is connected to the output of the reading latch R_Latch_1 of the memory interface 12, counts the number of pieces of the image data being output, and when reaching the predetermined number, controls the output side selector 1 by asserting the control signal.

As a result, it is possible to provide a liquid crystal display driver having the same effect as the liquid crystal display driver IC described in the above-described third embodiment, even with regard to the liquid crystal display driver IC 10 in which the RAM 11 is embedded as the frame memory.

FIG. 17 is a truth table for explaining an example of a switching operation of an input side selector performed by a terminal, in the liquid crystal display driver IC with the embedded RAM according to the fourth embodiment. In the same manner as the truth table illustrated in FIG. 11, when the terminal PIN_2 is "0", the communication interface circuit (DSI_1) 3_1 is connected to the slot (Slot_1) 4_1, and the communication interface circuit (DSI_2) 3_2 is connected to the slot (Slot_2) 4_2. When the terminal PIN_2 is "1", the communication interface circuit (DSI_2) 3_2 is connected to the slot (Slot_1) 4_1, and the communication interface circuit (DSI_1) 3_1 is connected to the slot (Slot_2) 4_2.

FIG. 18 is a truth table for explaining an example of a switching operation of an output side selector performed by a terminal, in the liquid crystal display driver IC with the embedded RAM and the mounted pixel data counter according to the fourth embodiment. In the same manner as that of the truth table illustrated in FIG. 12, the number of used input ports is designated by the terminal PIN_1. In a case where two ports are used, PIN_1 is set to "0", and in a case where only one port is used, PIN_1 is set to "1". Whether or not to perform the left-right reversing of the image is set by an F/B bit set in the control register 8. When the left-right reversing is performed, the F/B bit is set to "1", and when the left-right reversing is not performed, the F/B bit is set to "0".

When PIN_2=0, PIN_1=0, and F/B=0, the image data input from the communication interface circuit (DSI_1) 3_1 is written to the writing latch W_Latch_1 via the slot (Slot_1) 4_1, and the data is read out to the reading latch R_Latch_1, and then transferred to the latch 5_1. The image data input from the communication interface circuit (DSI_2) 3_2 is written to the writing latch W_Latch_2 via the slot (Slot_2) 4_2, and the data is read out to the reading latch R_Latch_2, and then transferred to the latch 5_2. Including the other case, while the image data input from the communication interface circuits (DSI_1 and DSI_2) 3_1 and 3_2 is transferred to the latches 5_1 and 5_2 via the slots (Slot_1 and Slot_2) 4_1 and 4_2, the only different point is that operations in which the image data is written to the writing latches W_Latch_1 and W_Latch_2 and is read out to the reading latches R_Latch_1 and R_Latch_2 and is temporarily stored in the RAM, are added.

As described above, the setting of "1" or "0" set in the truth table is just an example, and it may be a different setting, or may be positive logic or negative logic.

As described above, the invention performed by the present inventor is specifically described based on the embodiments, but the present invention is not limited thereto, and various modifications can be made within a range without departing from the gist.

For example, a touch panel may be stacked on the liquid crystal display panel 20, and a touch controller may be embedded in the liquid crystal display driver IC. In addition, instead of the terminals PIN_1 and the PIN_2, fuses or non-volatile memory devices can also be mounted.

What is claimed is:

1. An LCD driver IC which is configured to be able to connect to a host processor and a plurality of communication channels, which is configured to be able to drive a plurality of source lines of a display panel, and which can drive the source lines of the display panel based on the image data supplied from the host processor via the communication channels, comprising:

a plurality of communication interface circuits which can be connected to the plurality of communication channels;

a plurality of driving circuits which drive each of the plurality of sources lines;

a plurality of latches which is connected to input of each of the plurality of driving circuits and retains the data supplied to each of the driving circuits; and a first selector circuit which can select to which one of the plurality of latches each of a plurality of image data outputs received from each of the plurality of communication interface circuits is supplied.

2. The LCD driver IC according to claim 1, further comprising:

a pixel data counter which counts the number of pieces of image data output from at least one of the plurality of communication interface circuits, wherein the first selector circuit is configured to be able to change a supply relationship of the image data between the communication interface circuit and the latch, based on the count value of the pixel data counter.

3. The LCD driver IC according to claim 2, wherein the communication channel is configured to include one clock lane and four data lanes according to an MIPI/DSI standard.

4. The LCD driver IC according to claim 1, further comprising:

a second selector circuit;

a plurality of video adaptors;

a command adaptor; and a control register, wherein the second selector circuit is configured to be able to select to which one of the plurality of video adaptors instead of the plurality of latches each of the plurality of image data outputs respectively received from the plurality of communication interface circuits is supplied, the plurality of video adaptors extracts the image data from the data received from the communication interface circuits, and supplies the data to the first selector circuit, the command adaptor is connected to one of the plurality of video adaptors, extracts a command from the data received from the communication interface circuit, and sets a value based on the extracted command in the control register, and the first selector circuit is configured to be able to select to which one of the plurality of latches each of the plurality of image data outputs respectively extracted by the plurality of video adaptors is supplied, based on the value set in the control register.

5. The LCD driver IC according to claim 4, further comprising:

a pixel data counter which counts the number of pieces of image data output from at least one of the plurality of video adaptors, wherein the first selector circuit is configured to be able to change a supply relationship of the image data between the video adaptor and the latch, based on the count value of the pixel data counter.

6. The LCD driver IC according to claim 5, wherein the communication channel is configured to include one clock lane and four data lanes according to an MIPI/DSI standard.

7. The LCD driver IC according to claim 4, further comprising:

one or more second selector control terminals, wherein the second selector circuit is configured to be able to select which of the data received from one of the plurality of communication interface circuits is supplied to the command adaptor, based on a value set in the second selector control terminal.

8. The LCD driver IC according to claim 7, wherein the communication channel is configured to include one clock lane and four data lanes according to an MIPI/DSI standard.

9. The LCD driver IC according to claim 4, wherein the communication channel is configured to include one clock lane and four data lanes according to an MIPI/DSI standard.

10. The LCD driver IC according to claim 1, further comprising:

a memory; and a memory interface circuit, wherein the memory interface circuit is configured to be able to write the image data output from the plurality of communication interface circuits to the memory, read out the written image data from the memory, and supply the read image data to the first selector circuit.

11. The LCD driver IC according to claim 10, wherein the communication channel is configured to include one clock lane and four data lanes according to an MIPI/DSI standard.

12. Time LCD driver IC according to claim 1, further comprising:

a command adaptor; and a control register which includes a first selector control bit of one or more bits, wherein the command adaptor is configured to be able to write a set value based on the command received from at least one of the plurality of communication interface circuits to the first selector control bit of the control register, and the first selector circuit selects to which one of the plurality of latches each of the plurality of image data outputs respectively received from the plurality of communication interface circuits is supplied, based on a set value stored in the first selector control bit.

13. The LCD driver IC according to claim 12, wherein the communication channel is configured to include one clock lane and four data lanes according to an MIPI/DSI standard.

14. The LCD driver IC according to claim 1, further comprising:

one or more of a first selector control terminal, wherein the first selector circuit selects to which one of the plurality of latches each of the plurality of image data outputs respectively received from the plurality of communication interface circuits is supplied, based on a value set in the first selector control terminal.

15. The LCD driver IC according to claim 14, wherein the communication channel is configured to include one clock and four data lanes according to an MIPI/DSI standard.

16. The LcD driver IC according to claim 1, further comprising:

a command adaptor;

a control register which includes a first selector control bit of one or more bits; and one or more first selector control terminals, wherein the command adaptor is configured to be able to write a set value based on the command received from at least one of the plurality of communication interface circuits to the first selector control bit of the control register, and the first selector circuit selects to which one of the plurality of latches each of the plurality of image data outputs respectively received from the plurality of communication interface circuits is supplied, based on a set value stored in the first selector control bit and a value set in the first selector control terminal.

17. The LCD driver IC according to claim 16, wherein the communication channel is configured to include one clock lane and four data lanes according to an MIPI/DSI standard.

18. The LCD driver IC according to claim 1, wherein the communication channel is configured to include one clock lane and four data lanes according to an MIPI/DSI standard.

19. The LCD driver IC according to claim 1, wherein a communication interface circuit which is not connected to the plurality of communication channels, among the plurality of communication interface circuits can be set in a low power consumption state.

20. The LCD driver IC according to claim 1, wherein a driving circuit which is not connected to the plurality of source lines, among the plurality of driving circuits can be set a low power consumption state.

* * * * *